US006656253B2

(12) United States Patent
Willey et al.

(10) Patent No.: US 6,656,253 B2
(45) Date of Patent: Dec. 2, 2003

(54) DYNAMIC ELECTROSTATIC FILTER APPARATUS FOR PURIFYING AIR USING ELECTRICALLY CHARGED LIQUID DROPLETS

(75) Inventors: Alan David Willey, Cincinnati, OH (US); Vladimir Gartstein, Cincinnati, OH (US); Chinto Benjamin Gaw, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/282,586

(22) Filed: Oct. 29, 2002

(65) Prior Publication Data

US 2003/0196552 A1 Oct. 23, 2003

Related U.S. Application Data

(63) Continuation-in-part of application No. 10/039,854, filed on Oct. 29, 2001, now Pat. No. 6,607,579, which is a continuation-in-part of application No. 09/860,288, filed on May 18, 2001, now abandoned.

(60) Provisional application No. 60/205,356, filed on May 18, 2000.

(51) Int. Cl.[7] ..... B03C 3/014

(52) U.S. Cl. ..... 96/27; 96/53; 96/63

(58) Field of Search ..... 96/27, 53, 52, 96/44, 63; 95/61, 58, 71, 72

(56) References Cited

U.S. PATENT DOCUMENTS

| | | | | |
|---|---|---|---|---|
| 2,357,354 A | * | 9/1944 | Penney | 96/27 |
| 2,525,347 A | * | 10/1950 | Gilman | 95/71 |
| 3,802,625 A | * | 4/1974 | Buser et al. | 239/704 |
| 3,988,128 A | | 10/1976 | Hogg | |
| 4,095,962 A | | 6/1978 | Richards | |

(List continued on next page.)

FOREIGN PATENT DOCUMENTS

| | | |
|---|---|---|
| EP | 1 095 705 A2 | 5/2001 |
| KR | 10-2001-0038576 | 10/1999 |
| WO | WO 82/01481 A1 | 5/1982 |
| WO | WO 97/28883 A1 | 8/1997 |

OTHER PUBLICATIONS

"Honeywell F300E Electronic Air Cleaner" Product Data Sheet, published by Honeywell (2000), pp. 1–24.
"Honeywell F300 FAQ," from Internet site "Honeywell.com", published by Honeywell Inc. (1999), pp. 1–4.
Carrier Model AIRA Electronic Air Cleaner Product Data Sheet, published by Carrier Corporation (1999), pp. 1–4.
"Carrier Model AIRA Electronic Air Cleaner" advertisement, published by Carrier Corporation (1998), p. 1–2.
"EPA Air Pollution Technology Fact Sheet, Fabric Filter, HEPA and ULPA Type," pp. 1–8.

(List continued on next page.)

*Primary Examiner*—Richard L. Chiesa
(74) *Attorney, Agent, or Firm*—Bart S. Hersko

(57) ABSTRACT

An apparatus for removing particles from air, including an inlet for receiving a flow of air, a first chamber in flow communication with the inlet, wherein a charged spray of semiconducting fluid droplets having a first polarity is introduced to the air flow so that the particles are electrostatically attracted to and retained by the spray droplets, and an outlet in flow communication with the first chamber, wherein the air flow exits the apparatus substantially free of the particles. The first chamber of the apparatus further includes a collecting surface for attracting the spray droplets, a power supply, and a spray nozzle connected to the power supply for receiving fluid and producing the spray droplets therefrom. The apparatus may also include a second chamber in flow communication with the inlet at a first end and the first chamber at a second end, wherein particles entrained in the air flow are charged with a second polarity opposite the first polarity prior to the air flow entering the first chamber.

16 Claims, 14 Drawing Sheets

U.S. PATENT DOCUMENTS

| | | | | | |
|---|---|---|---|---|---|
| 4,239,504 | A | * | 12/1980 | Polizzotti et al. | 95/58 |
| RE30,479 | E | | 1/1981 | Cohen et al. | |
| 4,294,588 | A | * | 10/1981 | Polizzotti et al. | 95/58 |
| 4,549,243 | A | | 10/1985 | Owen et al. | |
| 4,738,690 | A | * | 4/1988 | Radway et al. | 95/58 |
| 4,776,515 | A | | 10/1988 | Michalchik | |
| 5,290,600 | A | | 3/1994 | Ord et al. | |
| 5,310,416 | A | * | 5/1994 | Borger et al. | 95/64 |
| 5,337,963 | A | | 8/1994 | Noakes | |
| 5,503,335 | A | | 4/1996 | Noakes et al. | |
| 5,518,525 | A | * | 5/1996 | Steed | 95/58 |
| 5,843,210 | A | * | 12/1998 | Paranjpe et al. | 95/59 |
| 5,902,380 | A | * | 5/1999 | Tomimatsu et al. | 96/27 |
| 5,914,454 | A | * | 6/1999 | Imbaro et al. | 95/64 |
| 5,958,361 | A | * | 9/1999 | Laine et al. | 423/610 |
| 5,980,614 | A | | 11/1999 | Loreth et al. | |
| 6,156,098 | A | | 12/2000 | Richards | |
| 6,500,240 | B1 | * | 12/2002 | Tomimatsu et al. | 96/27 |

OTHER PUBLICATIONS

"16$^{th}$ DOE Nuclear Air Cleaning Conference," Session 10, (Oct. 21, 1980), pp. 666–707.

"HEPA Filter Air Volumes" spec. sheet, from Internet site "airclean.co.uk," pp. 1–2, Dec. 21, 2001.

Hayati, I., et al., "Investigations into the Mechanisms of Electrohydrodynamic Spraying of Liquids," *Journal of Colloid and Interface Science*, vol. 117, No. 1 (May 1987), pp. 205–221.

Barrett, Leonard W., et al., "Aerosol Loading Performance of Electret Filter Media," *American Industrial Hygiene Association Journal*, 59 (Aug. 1998), pp. 532–539.

Van Turnhout, J., et al., "Electret Filters For High–Efficiency Air Cleaning," *Journal of Electrostatics*, 8 (1980), pp. 369–379.

Leith, David, et al., "Performance of industrial equipment to collect coolant mist," *American Industrial Hygiene Association Journal*, vol. 57, Issue 12 (Dec. 1996), pp. 1142–1148.

* cited by examiner

DYNAMIC ELECTROSTATIC FILTER APPARATUS FOR PURIFYING AIR USING ELECTRICALLY CHARGED LIQUID DROPLETS

CROSS-REFERENCE TO RELATED APPLICATIONS

The present application is a continuation-in-part of U.S. application Ser. No. 10/039,854, titled "Apparatus and Method for Purifying Air," filed on Oct. 29, 2001 now U.S. Pat. No. 6,607,579, which is a continuation-in-part to U.S. application Ser. No. 09/860,288, titled "System and Method For Purifying Air," filed on May 18, 2001, now abandoned, which claims benefit of U.S. Provisional Application No. 60/205,356, titled "System For Purifying Air," filed May 18, 2000, now abandoned.

TECHNICAL FIELD

The present invention relates generally to air cleaning equipment and is particularly directed to an air cleaner of the type which sprays electrically charged liquid droplets into the "dirty" air stream. The invention is specifically disclosed as an air filter that charges semiconductive liquid droplets and sprays them into a chamber in which an air flow that contains entrained dust particles is introduced. The particles are charged to one polarity, the liquid droplets are charged to an opposite polarity, and thus the particles are attracted to the droplets. The droplets are accumulated on a collecting surface, then recirculated and used again to collect further dust particles.

BACKGROUND OF THE INVENTION

Indoor air includes many small particles which, when inhaled or otherwise contacted by human beings, have a pernicious effect. Dust alone comprises dead skin, dust mite feces, pet dander, and other microscopic (less than 10 microns in size) particles which elicit a human immune response. This is exemplified by dust mite feces, which comprise a wide array of serine and cysteine protease enzymes that cause respiratory irritation and are responsible for many allergy symptoms.

While filtration systems have been used to reduce the amount of small particles present in selected locations, many of the most commonly irritating materials still exist as particles within a range of about 0.1 micron to about 10 microns in size. Filters having pore openings small enough to be effective at removing particles in this size range are known to become easily occluded and generate high backpressure, thereby requiring high power air blowers. Moreover, the ability to maintain proper air conduction through such filters requires a significant amount of electrical energy, is expensive and cumbersome.

Other types of air purifying devices, such as ionic and electrostatic devices, utilize the charge on particles to attract them to a specified collecting surface which is charged at an opposite polarity. Such devices require the collecting surface to be cleaned constantly and have met with limited success in terms of efficiency.

It will be appreciated that small particles can collect in the home and be re-breathed by the occupants without the benefit of elaborate and high power consumption filtration systems found in the public domain. One vestige of prior art systems is their size and high electrical power demand, which affects the cost of operation and the aesthetics of a sizable filtration apparatus.

With regard to the patent literature, an electrostatic scrubber is disclosed in U.S. Pat. No. 4,095,962 (by Richards) which produces highly charged liquid droplets without a concurrent production of a corona by providing a nozzle configured such that the nozzle's tip forms a substantially uniform electric field over the surface of the liquid on the tip, and this field is large enough to pull off droplets from the tip but not so large so as to create a corona discharge. Selected gas, solid particulates, and liquid mists from gaseous effluents are removed by an electrostatic collector that attracts the highly charged droplets. The droplets are caused to drift, by means of an electric field, through the gaseous effluent to a collecting electrode, thereby absorbing selected gases and aerosol particles, and carrying them to the collecting electrode. The droplet size of the charged droplets is in the range of 30–800 microns radius. One of the recommended scrubbing liquids is ammonium hydroxide, which is used when the effluent gas is sulphur dioxide.

Another patent by Richards, U.S. Pat. No. 6,156,098, also discloses a charged droplet gas scrubber apparatus, which allows scrubbing of uncharged particulates by use of a monopole-dipole attractive force between the charged liquid droplets and the electric dipoles that are induced in the uncharged particulates. The droplet production and charging produces a set of "spreading liquid sheet electrodes" in which the droplets are emitted from the edges of the liquid sheets, and these liquid sheets are interspersed with electrically conductive induction electrodes. This configuration again prevents corona discharge while charging the liquid droplets. Once the droplets are charged, they induce an electric dipole moment in the particulate particles. The droplets are collected by an impingement separator, and the liquid is then collected in a sump and strained through a strainer. In Richards '098, the liquid preferably is a conductive liquid such as tap water, and the size of the droplets is in the range of 25–250 microns diameter. An optimum size of these droplets is stated as being 140 microns. In situations where water is the liquid, the system can be an open-loop system, and the water need not be recirculated. Other liquids could be used, but they must have a minimum conductivity of 50 microSiemens per centimeter (which is 5 $Ohm^{-1}$-$meter^{-1}$). Richards '098 does not use the electrical charge on the droplets to "clean" the dirt particles in the air. Instead, the Richards device is merely attempping to create water droplets from a stream of water, not necessarily to retain an electrical charge on those droplets.

The two Richards patents are not directed toward room or office air cleaning systems, but are specifically directed toward scrubbing effluent gases, such as those produced in a power plant. Furthermore, the Richards patents use a conductive liquid, and this liquid is not necessarily recirculated, particularly when water is used since it is substantially inexpensive. Another feature of the two Richards patents is that the water droplets are fairly large in size, and again are directed toward removing fairly large particles from effluent gases, at a substantially high temperature in most cases. Such large droplets are not going to be substantially effective in removing particulate matter that is relatively small in particle size.

Another patent in this field is U.S. Pat. No. 3,958,959, by Cohen, which discloses a method of removing particles and fluids from a gas stream using charged droplets having a size between 60–250 microns, in which the preferred size is between 80–120 microns. The droplets are generated by ejecting a stable jet of liquid, such as water, in which the liquid jet is broken into charged droplets by applying an electric potential between the jet and the collecting walls of the scrubber. As the droplets are sprayed between two grounded wall plates, dirty inlet air flows at an angle to the liquid droplet flow direction and, once charged, the droplets are attracted to the walls. Since the droplets are moving at an angle to the direction of movement of the gas stream, this increases the relative velocity between the droplets and the particles. After the droplets impact against the grounded wall plates, they flow to the bottom of the walls and are collected in troughs below the walls, and this liquid thus contains some of the particulates from the gas stream. The resulting slurry is recirculated and the particulate matter is removed by a media filter. In this invention, the "droplet drift time" is generally less than 25 milliseconds.

The droplets in Cohen may consist of water, and in some cases there may be chemical agents added to the water that will react with the gas components that are to be removed. An example of such a chemical agent is sodium hydroxide for removing sulphur dioxide. Examples of collecting efficiency are illustrated in FIG. 12, which shows curves representing the specific collecting area in square feet per cfm (cubic feet per minute) of air volume movement. The curves are generated for mean particle sizes in the range of 1–10 microns, and it is clear that the smaller the particle size, the less the overall collecting efficiency. None of the curves run down to the 0.3 micron particle size, and it is clear that a fairly large specific collecting area would be required to keep efficiencies above 80–90% (and this is only an extrapolation of these curves: nothing is said in the patent document as to whether those curves can realistically be extrapolated in the lower particle size range).

Another patent document in this field is EP 1 095 705 A2, owned by ACE Lab, Inc., which discloses an air cleaning device that produces electrically charged "hyperfine liquid droplets" that are formed through an electro-hydrodynamic atomization process which applies a high voltage to capillaries that have nozzles at their tips from which the liquid is ejected in the form of the hyperfine liquid droplets. These liquid droplets "absorb" dust laden air that are flowing through a duct. In actuality, the charged liquid droplets attach themselves to the particles in the dust laden air, and these particles now receive a charge from those liquid droplets. The air flow is directed into an electrostatic dust collector (i.e., an electrostatic precipitator) which has parallel plates that are alternately charged and grounded, thereby forming an electric field that has a polarity opposite to the charge imparted by the liquid droplets. Water is used as an exemplary liquid, because it not only can carry an electrical charge a short distance, but can also humidify the discharged air. Although this EPO document states that the liquid droplets absorb the dust, in reality the opposite is true: the hyperfine liquid droplets are much smaller than the dust, and the main inventive thrust of this invention is a clever way to impart an electrical charge to the dust particles of the inlet air without causing a corona effect. The ACE Lab's patent (the EP patent) discloses a system where the water droplets are quickly attracted to the particles of dust in the incoming air, and the electrical charge is thereby transferred to the dust. Consequently, a very short relaxation time can be useful and thus water can be used as the liquid medium. This document states that "fine dust" that is smaller than 0.1 microns is "removed easily and effectively," and also states that experimental data showed that the device could remove up to about 90% dust from the air.

One consideration of whole house air cleaners is that, if water is used for the liquid that produces the electrostatically-charged droplets, it must be remembered that microbes can grow in the water. Therefore, it may not be desirable to use water in a recirculating system. However, water is cheap, so an air cleaner could be constructed using water to create the charged droplets if desired, in which case the water could be non-recirculating in a single-pass system. It also must be remembered, however, that water does not easily retain an electrical charge for any appreciable time period, and therefore, has a very short "relaxation time" since it is fairly highly conductive. A lesser conductive liquid would have a longer relaxation time and so could retain the electrical charge for a much longer time period. Such a "semiconductive" liquid will preferably have the ability to travel several inches or more while retaining the full electrostatic charge that is imparted upon its droplets as they are ejected from the nozzles, thereby having the ability to attract particles from the inlet "dirty" air throughout their entire travel from the nozzle to a collecting plate or container. This principle is utilized in the present invention, as discussed below in greater detail.

Many whole house air cleaners are constructed as electrostatic precipitators, mainly because such air cleaning devices have a fairly low backpressure (i.e., pressure drop) characteristic, thereby enabling a furnace to blow its entire outlet air through an air cleaner without incurring an exceedingly high pressure drop (which would otherwise require a much larger motor and greater electrical power consumption). While electrostatic precipitators are quite common, their dust collecting efficiency specifications leave much to be desired.

For conventional electrostatic air cleaners that are available today, the dust collecting efficiency is typically less than 70% for particles of 0.3 microns, and for the ASHRAE "dust spot test," the dust collecting efficiency is typically less than 78%. Moreover, electrostatic filters need to be kept clean, which is a critical characteristic having negative consequences that is often overlooked by the consumer or user of such electrostatic filters. In standard electrostatic filters, their metal plates or fiber media are easily covered by dust in rather short order, and when that occurs, the electrostatic filters become much less efficient. Furthermore, in fiber electrostatic filters that have a fairly high density of such fibers, once these fibers become covered by dust, the filter can literally become in effect a media filter (i.e., a filter that relies on mechanical means alone to prevent particles of a given size to penetrate therethrough, thus creating a greater backpressure characteristic.)

One example electrostatic air cleaner is manufactured by Honeywell, which has published a data sheet in 2000 for a model number "F300E" electronic air cleaner. In this data sheet, Honeywell stated that the "fractional efficiency" of the F300E was 70% on 0.3 micron particles at 500 feet per minute (fpm) air velocity.

This Honeywell document also has a chart called FIG. 1, which shows air cleaner efficiency and pressure drop at various airflow rates. This FIG. 1 shows efficiency ratings based upon the National Bureau of Standards "initial dust spot method" using the ASHRAE (American Society of Heating, Refrigerating and Air Conditioning Engineers) standard 52.1–92. When analyzing the airflow rates for the largest filter on this chart, which is 20×25 inches, at a velocity of 500 fpm, the airflow rate would be 1736 cfm (cubic feet per minute). At this airflow rate, the air cleaning efficiency is about 84% at a pressure drop of about 0.11 inches of water column. This would provide a Pressure Adjusted Efficiency (PAE)—which is a new characteristic for air filters created by the present inventors, in which the PAE is equal to the cleaning efficiency divided by the pressure drop-value of 764 (i.e., 84 divided by 0.11).

It is important to note that the above dust spot methodology is referred to as the "initial" dust spot method. This is very important especially with respect to electrostatic air cleaners, since their efficiency drops very quickly once the air cleaning elements begin to accumulate particles. This will be discussed below in more detail.

Another catalog of prior art electrostatic air cleaners has been published by Carrier Corporation in 1999 for an electronic air cleaner sold under the Model Number Series "AIRA" in sizes 012, 014, and 020. The largest filter element in this catalog is a 24½×20¼ filter, Model AIRAAXCC0020. Using the ASHRAE dust spot test, the "performance chart" for this filter at 500 feet per minute air velocity indicates an air cleaning efficiency of about 79% at a backpressure of about 0.07 inches of water column. This would provide a PAE value of about 1128. This very low backpressure specification obviously does not include any pressure drop for ducting, or geometric configuration of the inlet and outlet spaces that bring air to and from the filter element itself.

As can be seen from the above information, particularly the information on the Honeywell F300E air cleaner specifications, it is much easier to obtain a higher cleaning efficiency using the ASHRAE dust spot method than it is for a flow of air containing a single particle size, such as 0.3 micron particles. There are two main reasons for this: in the first place, the ASHRAE dust spot test includes particles of many sizes, a large number of which are greater than 0.3 microns in size; the second reason is that the ASHRAE dust spot test uses particles that often tend to clump together, so that the effective particle size is even larger than the individual particle sizes.

A type of media air filter commonly used in rooms of offices and homes is the HEPA filter, which is specified as having a 99.97% cleaning efficiency for removing particles of 0.3 microns in diameter or larger. This is a standard industry specification, as noted in an EPA publication known as a "EPA-CICA Fact Sheet" for fabric filters of the HEPA and ULPA type. HEPA filters typically have a relatively large surface area per unit volume of air to be cleaned moving therethrough, otherwise the pressure drop (or backpressure) would be very high, and thus require a very large motor for operation. The typical pressure drop for a "clean" filter is about 1 inch of water column. As the filter is used and begins to accumulate dust or dirt particles, the pressure drop will increase, and when it reaches between 2 and 4 inches of water column, that typically indicates the end of the service life of the filter. Some HEPA filters when they are "clean" have lower pressure drops in the range of 0.25–0.5 inches of water column.

HEPA filters are typically operated under a pressure of up to four (4) inches of water column, and higher operating pressures may rupture the filter. HEPA filters are used quite often in cleaning the air of individual rooms, but are not common for a "whole home" air cleaning system. The main reason for this fact is that the air flow through a typical furnace or air conditioner of a typical home is much too large for a HEPA filter of a reasonable size. In other words, the HEPA filter would have to be huge to handle the total amount of volume of air that passes through a typical furnace or air conditioner of a home.

One example of the operating characteristics for a HEPA filter is provided at an Internet website for a company named Airclean in the United Kingdom, having an Internet website domain name of "airclean.co.uk." According to one of the tables provided at this website, a HEPA filter having a media size 24 inches×24 inches would have a pressure drop of about 0.803 inches of water (200 Pa) at an air velocity of 60 fpm (feet per minute). For this HEPA filter, the PAE characteristic would be a value of about 124.5 (99.97%÷0.803 inches of water).

HEPA-type filters are also used in nuclear environments, although such environments typically require a much greater air cleaning efficiency specification. Consequently, the air flow running through such filter media is generally much slower, and a typical specification is an air velocity of 5 fpm (feet per minute). One paper that describes such filters in some detail is provided in excerpts from the "16$^{th}$ DOE Nuclear Air Cleaning Conference, Session 10." On page 673 of this report, various nuclear HEPA filters running at 5 fpm media velocity exhibit initial pressure drops of between 0.92 and 1.27 inches of water column. Such filters are deemed to come to the end of their useful life when the "final" pressure drop rises to 3 inches of water column. Such nuclear installations have media filters that can literally fill a large room, since they have to handle a very large volume of air (e.g., for an entire nuclear plant office facility). Consequently, such filters are not considered useful for a home or standard office building.

The table on page 680 of the Nuclear Air Cleaning Conference excerpts is quite revealing with respect to the lifetime of the HEPA filter, as well as its change in pressure drop characteristics over time. For example, one of the filters changed in two months from a pressure drop of 1.04 to 1.37 inches of water column, which is a change of about 32% in two months. Two other filters are shown to have changed their pressure drop characteristics over a four month operating time from 1.1 to 1.5 inches of water column, which is a change of about 36% in backpressure characteristics over that four month time span. This is an increase of almost 9% per month in backpressure for this type of filter. A corresponding pressure increase can be expected in other types of HEPA filters and also ULPA filters as well.

HEPA filters require a certain amount of electrical power for fans to blow the air through the media-type filter. Such fans typically require an electric motor that requires about ½ watt to 1 watt per cfm (cubic feet per minute) of fan and air volume movement capacity. When used as a room air cleaner, a typical HEPA filter will circulate about 350 cfm of air volume, for a room about 20 feet×20 feet in area. The electrical power requirement for such a HEPA room air cleaner is typically in the range of 180–200 watts.

Some disadvantages of using HEPA filters as "room" filters are as follows: the HEPA filter is typically noisy, requires a large backpressure for operation, and allows microbes to find their way into the filter and remain there. In situations where microbes are lodged in the filter media, when the filters are changed the microbes can be released into the air. Such filters are often used in confined systems where the air is recirculated, such as in jet aircraft. The microbes will be continually recirculated or will be trapped in the filter media; however, they can still be released into the air when the filter is changed or otherwise "cleaned."

Another characteristic that can be discussed is the "permeability" of a filter, which represents a percentage of the "void" divided by the percentage of "volume" of a filter medium. For HEPA filters, the permeability is typically less than 1%. This means that the air molecules are much more likely to "bump" into the filter media than to be able to pass through the filter media without some type of impact, thus creating a significant backpressure. In the present invention, the permeability of the filter is much greater. One consequence of the HEPA filter's backpressure characteristic is a substantial noise level generated by the fan, which can be as high as 70 dB for a 20×20 foot room air cleaner.

Accordingly, it is desirable that an apparatus and method of purifying air be developed which is capable of removing particles of a specified size (about 0.1 micron to about 10 microns) in a manner which is adaptable, non-intrusive, and ergonomically compatible. It is also desirable that a fluid, as well as the requisite attributes thereof, be determined for use with the apparatus and method of purifying air which satisfies the electrical and sprayability demands required for use as the spray. It is further desirable to provide a dynamic electrostatic air cleaning apparatus that improves both backpressure and air cleaning characteristics over those of both HEPA filters and electrostatic precipitators.

SUMMARY OF THE INVENTION

Accordingly, it is an advantage of the present invention to provide a dynamic electrostatic air cleaning apparatus that exhibits a substantially high air cleaning efficiency while also exhibiting a substantially low backpressure when air flows therethrough at useful rates for cleaning a whole home, or merely a single room.

It is another advantage of the present invention to provide a dynamic electrostatic air cleaning apparatus that exhibits a substantially high air cleaning efficiency while also exhibiting a substantially low backpressure over a substantial time period of continuous operation without either cleaning or replacing a major component of the apparatus.

It is a further advantage of the present invention to provide a dynamic electrostatic air cleaning apparatus that compares favorably to conventional electrostatic precipitators by exhibiting an air cleaning efficiency greater than 70% at a backpressure of less than 0.2 inches of water column at an air velocity of substantially 2.54 meters per second (500 fpm), when the particles in the inlet air are substantially 0.3 microns in size.

It is yet a further advantage of the present invention to provide a dynamic electrostatic air cleaning apparatus that compares favorably to conventional electrostatic precipitators by exhibiting an air cleaning efficiency greater than 85% at a backpressure of less than 0.1 inches of water column at an air velocity of substantially 2.54 meters per second (500 fpm), when the particles in the inlet air are according to the ASHRAE dust spot test.

It is still a further advantage of the present invention to provide a dynamic electrostatic air cleaning apparatus that compares favorably to conventional HEPA filters by exhibiting an air cleaning efficiency of substantially 99.97% at a backpressure of less than 0.8 inches of water column at an air velocity of substantially 0.4572 meters per second (90 fpm), when the particles in the inlet air are substantially 0.3 microns in size.

It is still another advantage of the present invention to provide an electrostatic air cleaning apparatus that quickly cleans air from an enclosed space by use of electrically charged solid beads or other-shaped particles/objects that attract sub-micron particles entrained in the inlet air, including biohazardous materials, without substantial change to the temperature and humidity of the input air; in this apparatus, the solid beads are not recirculated.

In accordance with a first aspect of the present invention, an apparatus for removing particles from air is disclosed as including at least one inlet for receiving a flow of air, a first chamber in flow (i.e., fluidic) communication with the inlet, wherein a charged spray of semiconducting fluid droplets having a first polarity is introduced to the air flow passing therethrough so that the particles are electrostatically attracted to and retained by the spray droplets, and an outlet in flow communication with the first chamber, wherein the air flow exits the apparatus substantially free of the particles. The first chamber of the apparatus further includes a collecting surface for attracting the spray droplets, a power supply, and a spray nozzle connected to the power supply for receiving fluid, producing the spray droplets therefrom, and charging the spray droplets.

In accordance with a second aspect of the present invention, the apparatus may also include a second chamber in flow communication with the inlet at a first end and the first chamber at a second end, wherein particles entrained in the air flow are charged with a second polarity opposite the first polarity prior to the air flow entering the first chamber. The second chamber of the apparatus further includes a power supply, at least one charge transfer element connected to the power supply for creating an electric field in the second chamber, and a ground element associated with the second chamber for defining and directing the electric field, wherein the air flow passes between the charge transfer element and the ground element.

In accordance with a third aspect of the present invention, the apparatus may further include a fluid recirculation system in flow communication with the first chamber for providing the fluid from the collecting surface to the spray nozzle. The fluid recirculation system includes a device in flow communication with the collecting surface, a reservoir in flow communication with the device, and a pump for providing the fluid to the spray nozzle. The fluid recirculation system may also include a filter positioned between the collecting surface and the pump for removing the particles from the fluid, as well as a device for monitoring the quality of the fluid prior to being pumped to the spray nozzle. A replaceable cartridge may be utilized to house the reservoir, where the cartridge includes an inlet in fluid communication with the collecting surface of the first chamber at a first end and the reservoir at a second end and an outlet in fluid communication with the reservoir at a first end and the pump at a second end.

In accordance with a fourth aspect of the present invention, an apparatus for removing particles from air is disclosed as including at least one defined passage having an inlet and an outlet, wherein each inlet receives a flow of air and the air flow exits the passage at each outlet, and a first area positioned between each inlet and each outlet where a charged spray of semiconducting fluid droplets having a first polarity is introduced within the passage so that particles entrained within the air flow are electrostatically attracted to and retained by the spray droplets. The apparatus further includes a collecting surface associated with the first area of the passage for attracting the spray droplets, as well as a spray nozzle associated therewith for receiving fluid, producing the spray droplets in the first area of the passage, and charging the spray droplets. The apparatus may also include a second area positioned between the inlet and the first area, wherein particles entrained in the air flow are charged with a second polarity opposite the first polarity. The second area includes at least one charge transfer element associated therewith for creating an electric field in the second area of the passage, as well as a ground element associated therewith for defining and directing the electric field in the second area of the passage.

In accordance with a fifth aspect of the present invention, a method of removing particles from air is disclosed as including the steps of introducing a flow of air having particles entrained therein into a defined area and providing a charged spray of semiconducting fluid droplets having a first polarity to the defined area, wherein the particles are electrostatically attracted to and retained by the spray droplets, and attracting the spray droplets to a collecting surface. The method further includes the steps of forming the spray droplets from the fluid and charging the spray droplets. The method preferably includes the step of providing a charge to particles in the air flow at a second polarity opposite of the first polarity. The method may further include one or more of the following steps: filtering the air flow for particles having a size greater than a specified size; monitoring quality of the air flow; filtering the particles from the spray droplets; collecting the spray droplets in an aggregate of the fluid; recirculating the fluid aggregate for use in the spray; and, monitoring quality of the recirculated liquid prior to forming the spray.

In accordance with a sixth aspect of the present invention, a cartridge for use with an air purifying apparatus, wherein a charged spray of semiconducting fluid droplets is introduced to an air flow and collected so as to form a fluid aggregate, is disclosed as including a housing having an inlet and an outlet and a reservoir for retaining the fluid aggregate in flow communication with the inlet at a first end and the outlet at a second end. The cartridge may also include a filter located between the inlet and the reservoir, as well as a pump located between the reservoir and the outlet. The cartridge is configured for the inlet to be in flow communication with the collected fluid aggregate and the outlet to be in flow communication with a device for forming the fluid droplets in the air purifying apparatus. The cartridge housing may function as a collecting surface for the air purifying apparatus and include a spray nozzle associated therewith.

In accordance with a seventh aspect of the present invention, a fluid is disclosed for use as a spray in an air purifying apparatus, wherein particles in an air flow entering the air purifying apparatus are electrostatically attracted to droplets of the spray. The fluid has physical properties which enable a sprayability factor according to a designated algorithm within a specified range, where the sprayability factor is a function of certain physical properties of the fluid which relate to spray droplet size able to be formed and coverage and effectiveness of the spray. Such physical properties of the fluid include flow rate, density, resistivity, surface tension, dielectric constant, and viscosity. The sprayability factor also may be a function of an electric field formed in the air purifying apparatus to which the fluid is introduced. The fluid preferably is semiconducting, nonaqueous, inert, non-volatile and non-toxic.

Additional advantages and other novel features of the invention will be set forth in part in the description that follows and in part will become apparent to those skilled in the art upon examination of the following or may be learned with the practice of the invention. All percentages, ratios and proportions herein are by weight, unless otherwise specified. All temperatures are in degrees Celsius (° C.) unless otherwise specified. All documents cited are in relevant part, incorporated herein by reference.

To achieve the foregoing and other advantages, and in accordance with one aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and the chamber being configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber at an air velocity of substantially 2.54 meters per second (500 fpm), the plurality of particles at substantially 0.3 microns in size is cleaned from the input air at a cleaning efficiency of greater than 70%, at a backpressure of less than 0.2 inches of water column, and without substantial change to a temperature and humidity of the input air.

In accordance with another aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and the chamber being configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber at an air velocity of substantially 2.54 meters per second (500 fpm), the plurality of particles according to the ASHRAE dust spot test is cleaned from the input air at a cleaning efficiency of greater than 85%, at a backpressure of less than 0.1 inches of water column, and without substantial change to a temperature and humidity of the input air.

In accordance with yet another aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and the chamber being configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber at an air velocity of substantially 0.4572 meters per second (90 fpm), the plurality of particles at substantially 0.3 microns in size is cleaned from the input air at a cleaning efficiency of substantially 99.97%, at a backpressure of less than 0.8 inches of water column, and without substantial change to a temperature and humidity of the input air.

In accordance with still another aspect of the present invention, a single-pass air cleaning apparatus is provided, which comprises: a chamber into which a flow of input air is directed, the input air containing a plurality of particles, the input air becoming a flow of output air after being cleaned within the chamber; at least one nozzle through which a plurality of small solid objects are sprayed into the chamber, the solid objects being electrically charged; and the chamber being configured to cause the flow of input air and the charged solid objects to intermix at an intermix space, wherein the plurality of particles are attracted to the charged solid objects, thereby removing a portion of the plurality of particles from the input air, which thus becomes the flow of output air; wherein, when the flow of input air passes through the intermix space of the chamber, a very large portion of the particles exhibiting a sub-micron size are cleaned from the input air without substantial change to a temperature and humidity of the input air, and wherein the solid objects are not recirculated.

In accordance with a further aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and the chamber being configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber, the plurality of particles is cleaned from the input air at a pressure adjusted efficiency (PAE), which represents the cleaning efficiency in percent divided by the backpressure, that does not deviate by more than 25% after two months of continuous use of the air cleaning apparatus.

To achieve the foregoing and other advantages, and in accordance with one aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and in which the chamber is configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber at an air velocity of substantially 2.54 meters per second (500 fpm), the plurality of particles at substantially 0.3 microns in size is cleaned from the input air at a cleaning efficiency of greater than 70%, at a backpressure of less than 0.2 inches of water column, and without substantial change to a temperature and humidity of the input air.

In accordance with another aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and in which the chamber is configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber at an air velocity of substantially 2.54 meters per second (500 fpm), the plurality of particles according to the ASHRAE dust spot test is cleaned from the input air at a cleaning efficiency of greater than 85%, at a backpressure of less than 0.1 inches of water column, and without substantial change to a temperature and humidity of the input air.

In accordance with a further aspect of the present invention, an air cleaning apparatus is provided, which comprises: a chamber into which a flow of input air is directed, the input air containing a plurality of particles, the input air becoming a flow of output air after being cleaned within the chamber; at least one nozzle through which a liquid is sprayed into the chamber, the liquid being electrically charged, the liquid becoming separated into a plurality of droplets upon exiting the at least one nozzle; and in which the chamber is configured to cause the flow of input air and the charged liquid droplets to intermix at an intermix space, wherein the plurality of particles are attracted to the charged liquid droplets, thereby removing a portion of the plurality of particles from the input air, which thus becomes the flow of output air; wherein, when the flow of input air passes through the intermix space of the chamber at an air velocity of substantially 0.4572 meters per second (90 fpm), the plurality of particles at substantially 0.3 microns in size is cleaned from the input air at a cleaning efficiency of substantially 99.97%, at a backpressure of less than 0.8 inches of water column, and without substantial change to a temperature and humidity of the input air.

In accordance with still a further aspect of the present invention, a single-pass air cleaning apparatus is provided, which comprises: a chamber into which a flow of input air is directed, the input air containing a plurality of particles, the input air becoming a flow of output air after being cleaned within the chamber; at least one nozzle through which a plurality of small solid objects are sprayed into the chamber, the solid objects being electrically charged; and in which the chamber is configured to cause the flow of input air and the charged solid objects to intermix at an intermix space, wherein the plurality of particles are attracted to the charged solid objects, thereby removing a portion of the plurality of particles from the input air, which thus becomes the flow of output air; wherein, when the flow of input air passes through the intermix space of the chamber, a very large portion of the particles exhibiting a sub-micron size are cleaned from the input air without substantial change to a temperature and humidity of the input air, and wherein the solid objects are not recirculated.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

While particular embodiments and/or individual features of the present invention have been illustrated and described, it would be obvious to those skilled in the art that various other changes and modifications can be made without departing from the spirit and scope of the invention. Further, it should be apparent that all combinations of such embodiments and features are possible and can result in preferred executions of the invention.

Figure 1:
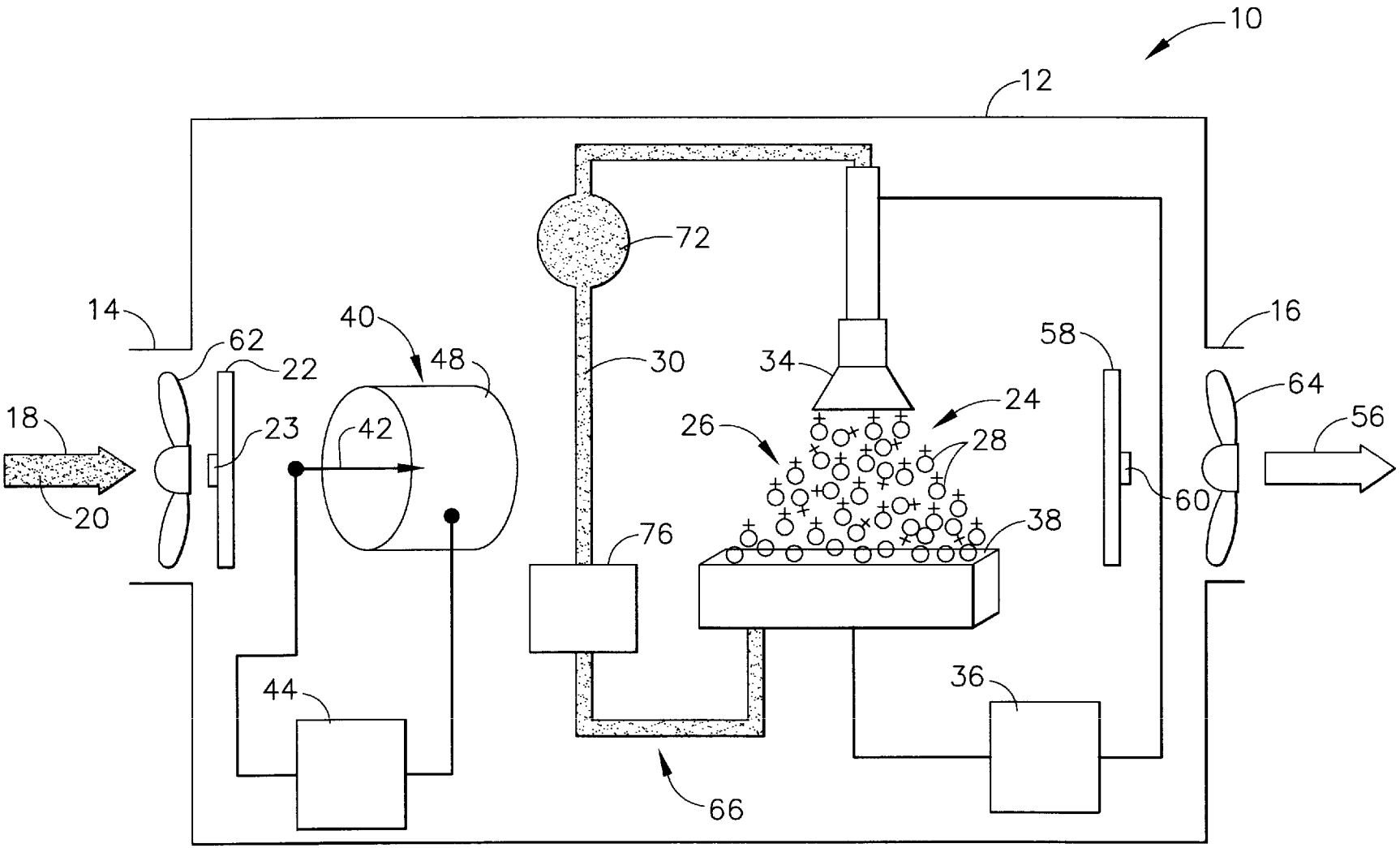
FIG. 1 is a diagrammatic view of a first embodiment for the air purification system of the present invention, where the flow of air into the system crosses the direction of the fluid spray therein.

As seen in FIG. 1, an apparatus 10 for purifying air includes a housing 12 having an inlet 14 and an outlet 16. It will be seen that inlet 14 is configured to receive an air flow designated generally by reference numeral 18. Air flow 18 is considered to be dirty air in the sense that it includes certain particles (identified by reference numeral 20) therein that are within a specified size range (approximately 0.1 micron to approximately 10 microns). A filter 22 is preferably included adjacent inlet 14 in order to prevent particles greater than the specified size from entering apparatus 10. A sensor 23 may also be located adjacent inlet 14 for monitoring the quality of air entering apparatus 10.

More specifically, apparatus 10 includes a first chamber or defined area 24 in flow communication with inlet 14 in which a charged spray 26 of semiconducting fluid droplets 28 having a first polarity (i.e., positive or negative) is introduced to air flow 18 passing therethrough to outlet 16. Spray droplets 28 are preferably distributed in a substantially homogenous manner within first chamber 24 so that particles 20 become electrostatically attracted to and retained by spray droplets 28. It will be seen that first chamber 24 includes a first device (e.g., a nozzle) for forming spray droplets 28 from a semiconducting fluid 30 supplied thereto and a second device (e.g., an electrostatically-charged member) for charging such spray droplets 28. It will be appreciated, however, that the charging device may perform its function either prior or subsequent to formation of spray droplets 28 by the first device.

Preferably, a spray nozzle 34 connected to a power supply 36 (approximately 18 kilovolts) is provided to serve the function of the first and second devices so that it receives the semiconducting fluid, produces spray droplets 28 therefrom, and charges such spray droplets 28. A collecting surface 38 spaced a predetermined distance from spray nozzle 34 is also provided in first chamber 24 to attract spray droplets 28, as well as particles 20 retained therewith. In this way, particles 20 are removed from air flow 18 circulating through apparatus 10. It will be appreciated that collecting surface 38 is either grounded or charged at a second polarity opposite the first polarity of spray droplets 28 to enhance attraction thereto. In order for apparatus 10 to perform in an effective manner, the charge on spray droplets 28 is preferably maintained until striking collecting surface 38, whereupon such charge is neutralized.

Figure 4:
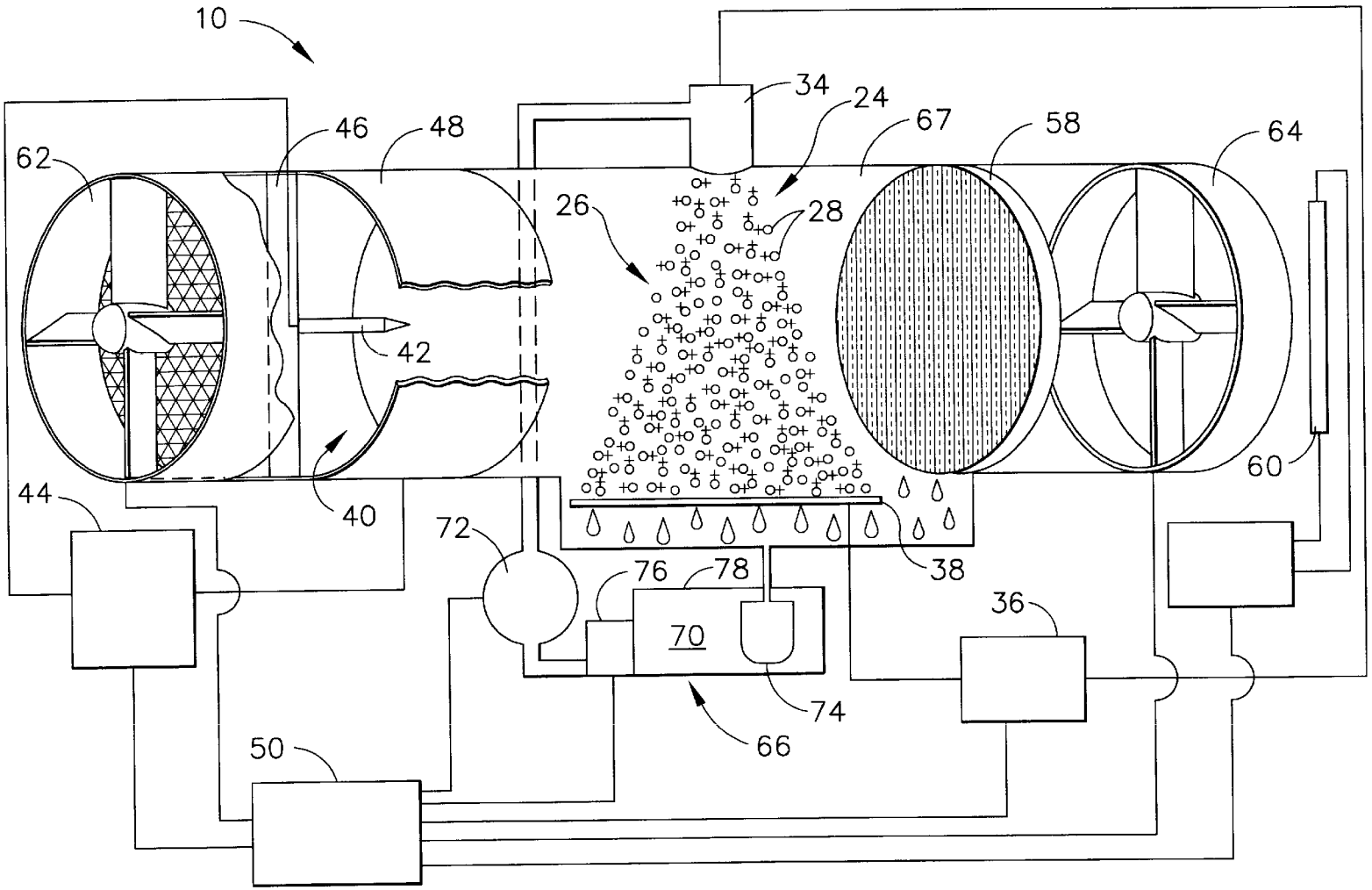
FIG. 4 is a diagrammatic view of the air purification system depicted in FIG. 1 within a defined passage.

Apparatus 10 preferably includes a second chamber or defined area 40 in flow communication with inlet 14 at a first end and first chamber 24 at a second end, wherein particles 20 entrained in air flow 18 are charged with a second polarity opposite the first polarity of spray droplets 28 prior to air flow 18 entering first chamber 24. In order to provide such charge, an electric field in second chamber 40 is preferably created by at least one charge transfer element 42 (e.g., a charging needle) connected to a power supply 44 (providing, for example, approximately 8.5 kilovolts). While charge transfer element 42 may be oriented in any number of directions, it is preferred that it be mounted within second chamber 40 so as to be substantially parallel to air flow 18. This may be accomplished as shown in FIG. 4 by a central support element 46 extending across second chamber 40. It will be appreciated that central support element 46 may be configured in any number of ways so long as it provides the required support for charge transfer element 42 and permits air flow 18 to move unencumbered through second chamber 40.

Second chamber 40 further includes a ground element 48 associated therewith for defining and directing the electric field created therein. It will be appreciated that air flow 18 passes between charge transfer element 42 and ground element 48. A collecting surface may also be associated with second chamber 40, where such collecting surface could be charged by charge transfer element 42 so as to be of opposite polarity to spray droplets 28 and thereby create an attraction. In order to better effect the charge on particles 20, a device may be provided in second chamber 40 for creating a turbulence in air flow 18 therein.

Turning back to first chamber 24, it will be understood that various configurations and designs may be utilized for spray nozzle 34 and collecting surface 38, but they should be matched so as to maintain a substantially uniform electric field in first chamber 24. Accordingly, when spray nozzle 34 is axisymmetric, collecting surface 38 preferably takes the form of a ring washer, a funnel, a perforated disk, or a cylinder of wire mesh as shown in FIGS. 6–9, respectively. It will be understood that collecting surface 38 preferably is a solid plate, solid bar, or perforated plate design when spray nozzle 38 is linear.

Figure 10:
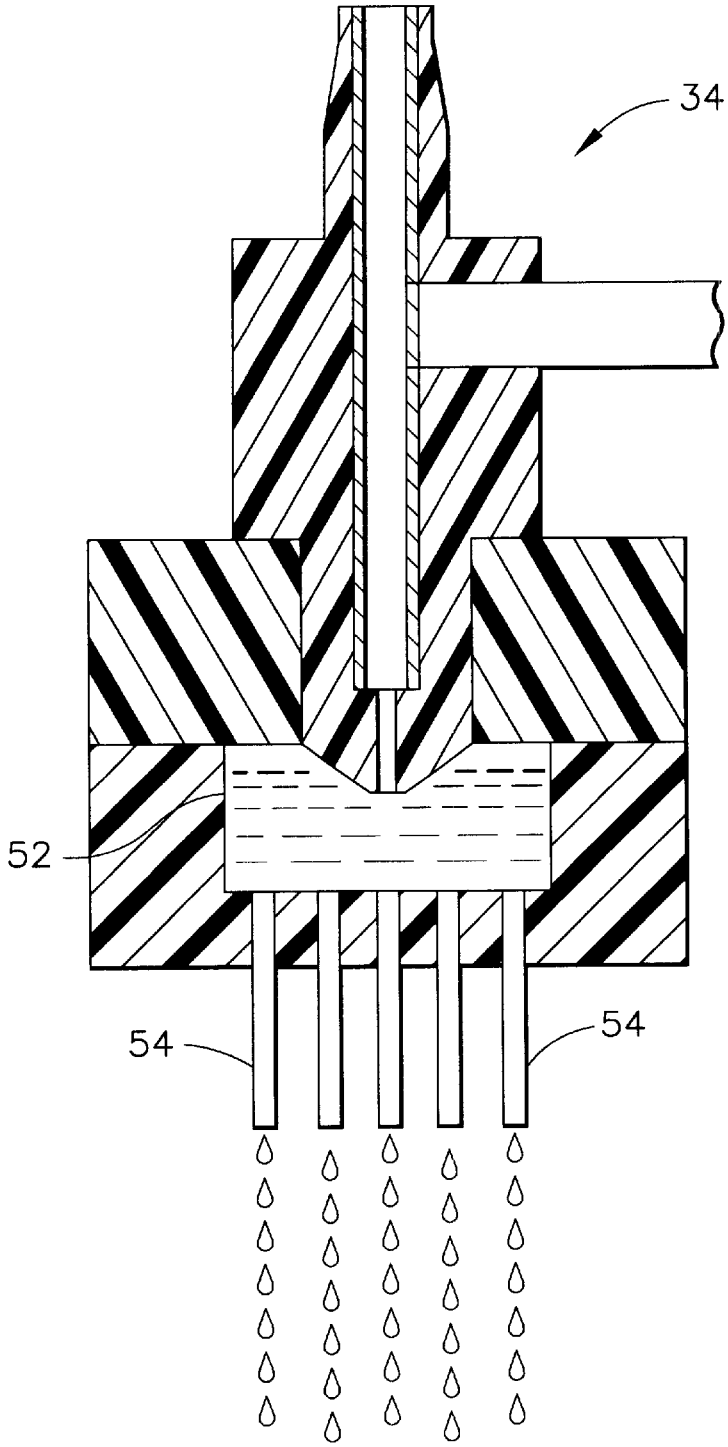
FIG. 10 is a side view in cross-section of an exemplary multi-nozzle design for a spray nozzle which may be utilized in the first chamber of the air purification system depicted in FIGS. 1–4.
Figure 11A:
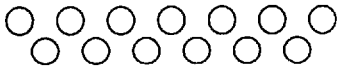
FIGS. 11A–11H are diagrammatic views of exemplary tube patterns for the multi-nozzle design depicted in FIG. 10.
Figure 11B:
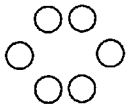
Figure 11C:
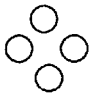
Figure 11D:
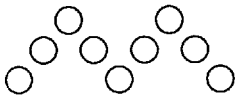
Figure 11E:
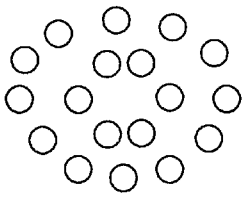
Figure 11F:
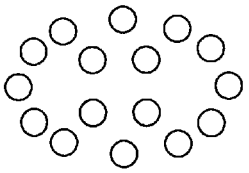
Figure 11G:
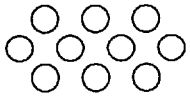
Figure 11H:
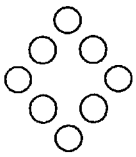

Another exemplary design for spray nozzle 34 is one where a multi-nozzle configuration is utilized. This may take the form of a Delrin body 52 with a plurality of spray tubes 54 in flow communication with such Delrin body 52 at a first end and first chamber 24 at a second end (see FIG. 10). It will be appreciated that any number of flow patterns may be provided by spray nozzle 34 when employing a multi-nozzle design as shown, for example, in FIGS. 11A–11H.

Figure 14:
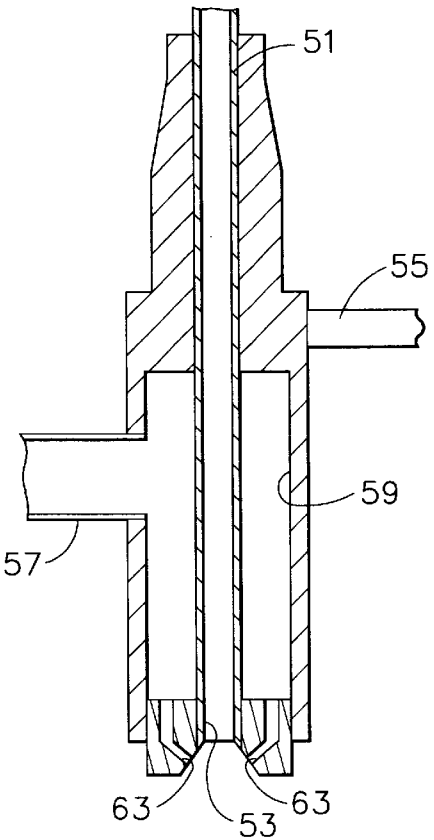
FIG. 14 is a side view in cross-section of a third spray nozzle design utilized in the first chamber of the air purification system including an air assist passage around the charging tube.
Figure 13:
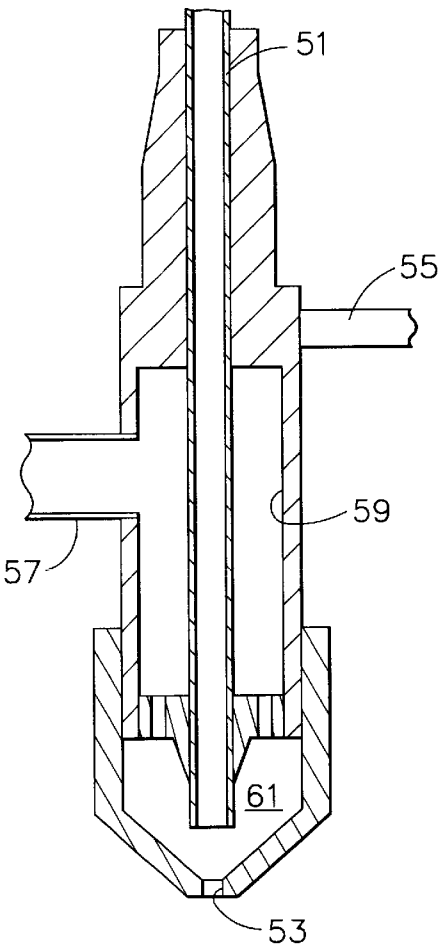
FIG. 13 is a side view in cross-section of a second spray nozzle design utilized in the first chamber of the air purification system including an air assist passage around the charging tube.
Figure 12:
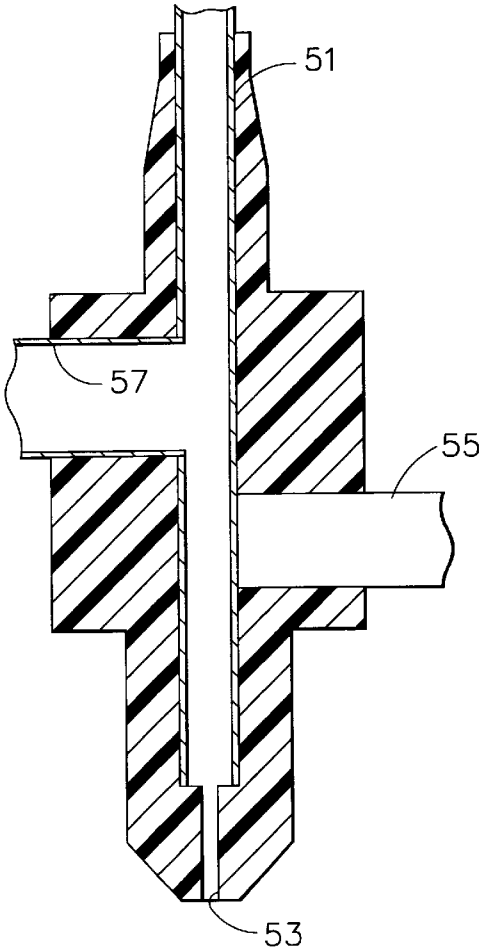
FIG. 12 is a side view in cross-section of a first spray nozzle design utilized in the first chamber of the air purification system including an air assist passage in flow communication with the charging tube.
Figure 15:
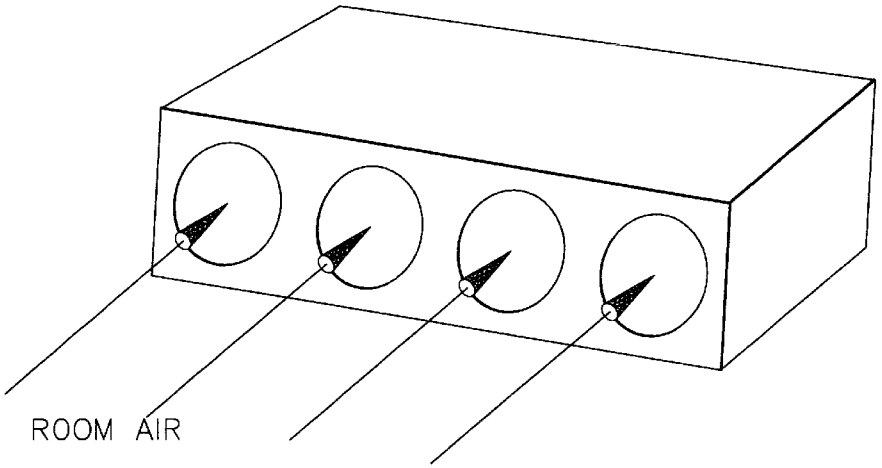
FIG. 15 is a diagrammatic perspective view of an air purification system having a plurality of defined passages therein as depicted in FIG. 4.
Figure 16:
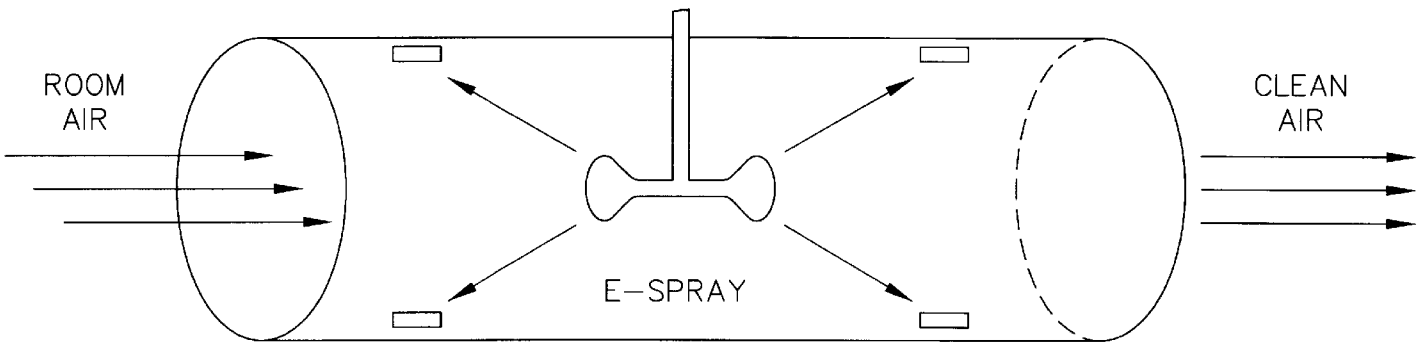
FIG. 16 is a diagrammatic side view of an air purification system where a defined passage has a plurality of collecting electrodes positioned therein.
Figure 17:
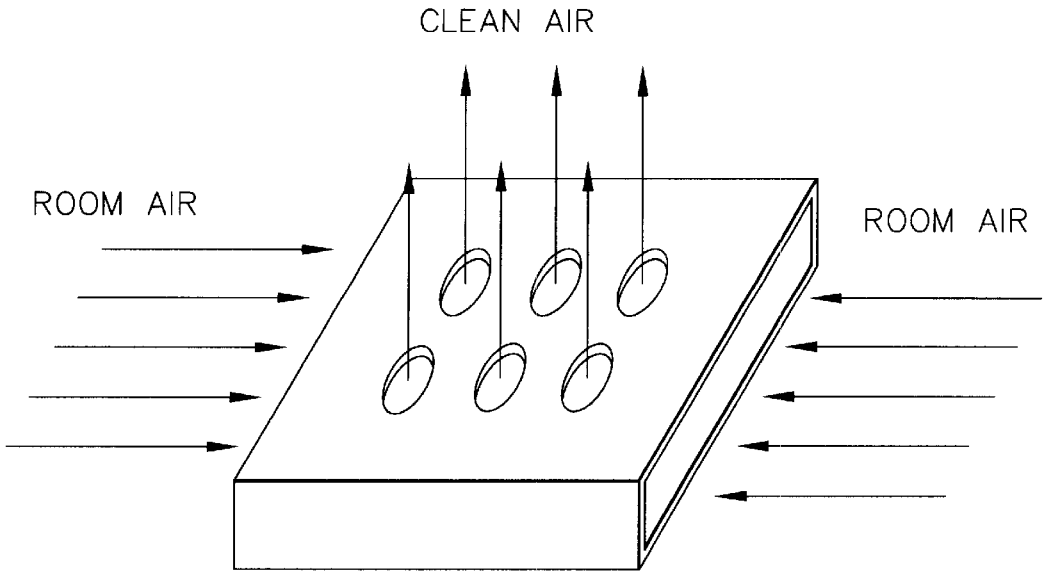
FIG. 17 is a diagrammatic perspective view of an air purification system like that depicted in FIG. 1 having a plurality of inlets and an outlet oriented at an angle thereto.
Figure 18:
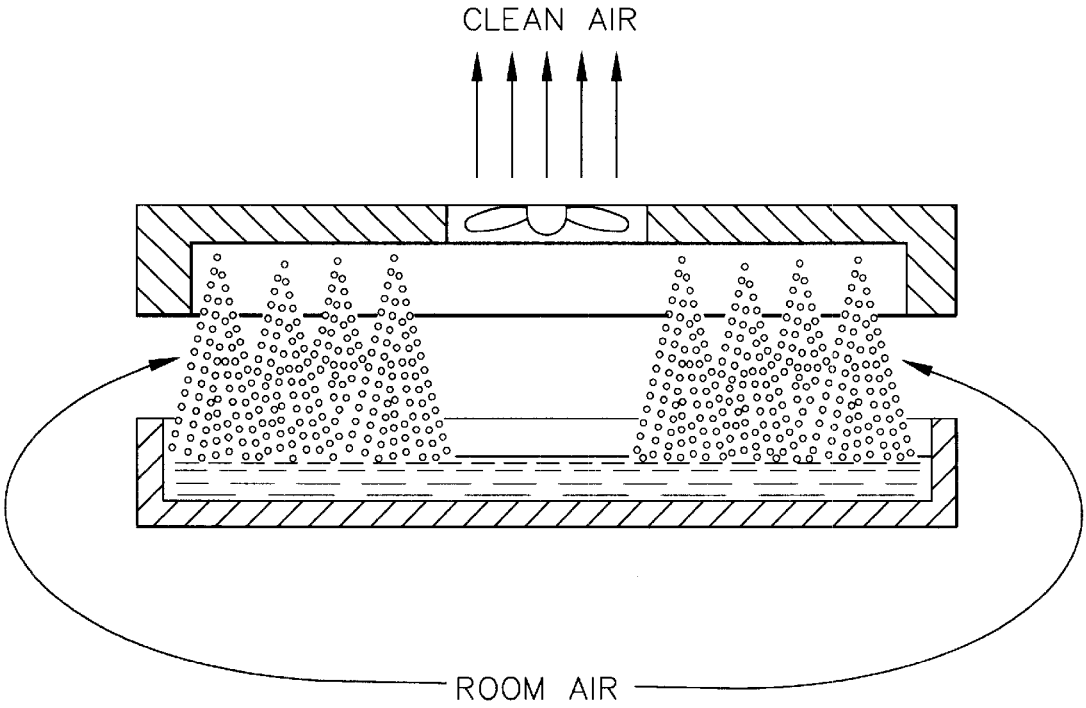
FIG. 18 is a diagrammatic side view of the air purification system depicted in FIG. 17 to indicate the pattern of the fluid spray therein.

It will be appreciated that spray droplets 28 may be produced in various ways from fluid 30. Since a high relative velocity is required between fluid 30 to be atomized and the surrounding air or gas, this can be accomplished by discharging fluid 30 at high velocity into a relatively slow moving stream of air or gas or exposing a relatively slow moving fluid to a high velocity air stream. Accordingly, those skilled in the art will understand that pressure atomizers, rotary atomizers, and ultrasonic atomizers may be utilized. Another device involves a vibrating capillary to produce uniform streams of drops. As seen in FIGS. 12–14, the present invention contemplates the use of air-assist type atomizers. In this type of spray nozzle, semiconducting fluid 30 is exposed to a stream of air flowing at high velocity. This may occur as part of an internal mixing configuration where the gas and fluid mix within the nozzle before discharging through the outlet orifice (see FIGS. 12 and 13) or an external mixing configuration where the gas and fluid mix at the outlet orifice (see FIG. 14).

While each spray nozzle configuration preferably includes a main conduit 51 through which the semiconducting fluid flows to an outlet orifice 53, as well as a charging element 55 connected to main conduit 51 for providing the desired charge to fluid/spray droplets 28 therein, it will be seen that a passage 57 also provides air to spray nozzle 34. In FIG. 12, passage 57 is in direct flow communication with main conduit 51 so as to mix fluid and air before exiting outlet orifice 53. FIGS. 13 and 14 depict passage 57 as being in flow communication with an internal cavity 59, whereupon the air provided therethrough is mixed with the fluid in either a separate cavity 61 before exiting outlet orifice 53 (FIG. 13) or as fluid is exiting outlet orifice 53 via separate passages 63 in flow communication with internal cavity 59 and located adjacent to outlet orifice 53 (FIG. 14). An exemplary spray nozzle utilizing air assistance is one designated as Model SW750 manufactured by Seawise Industrial Ltd.

Figure 2:
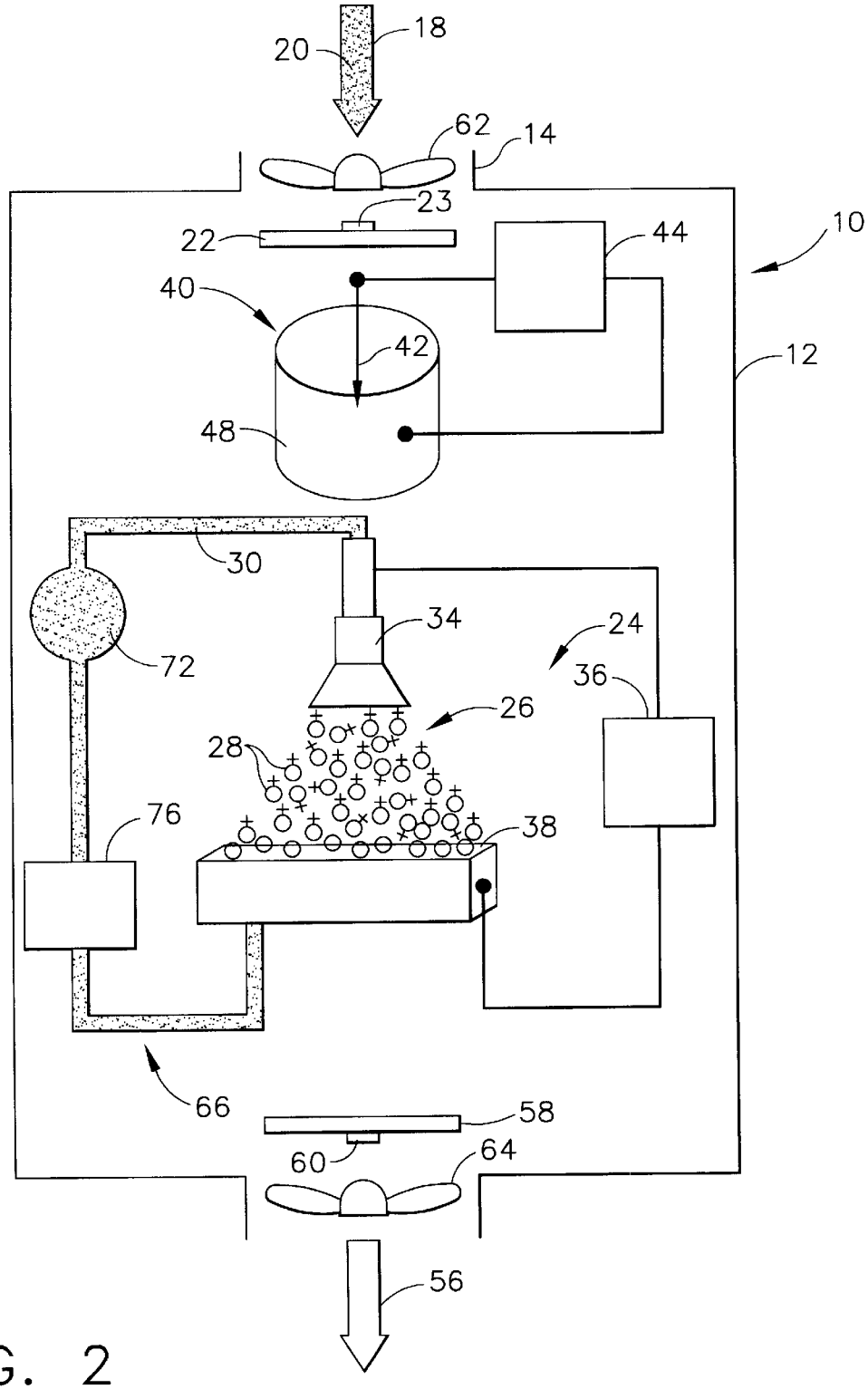
FIG. 2 is a diagrammatic view of a second embodiment for the air purification system of the present invention, where the flow of air into the system is in substantially the same direction as the fluid spray therein.
Figure 3:
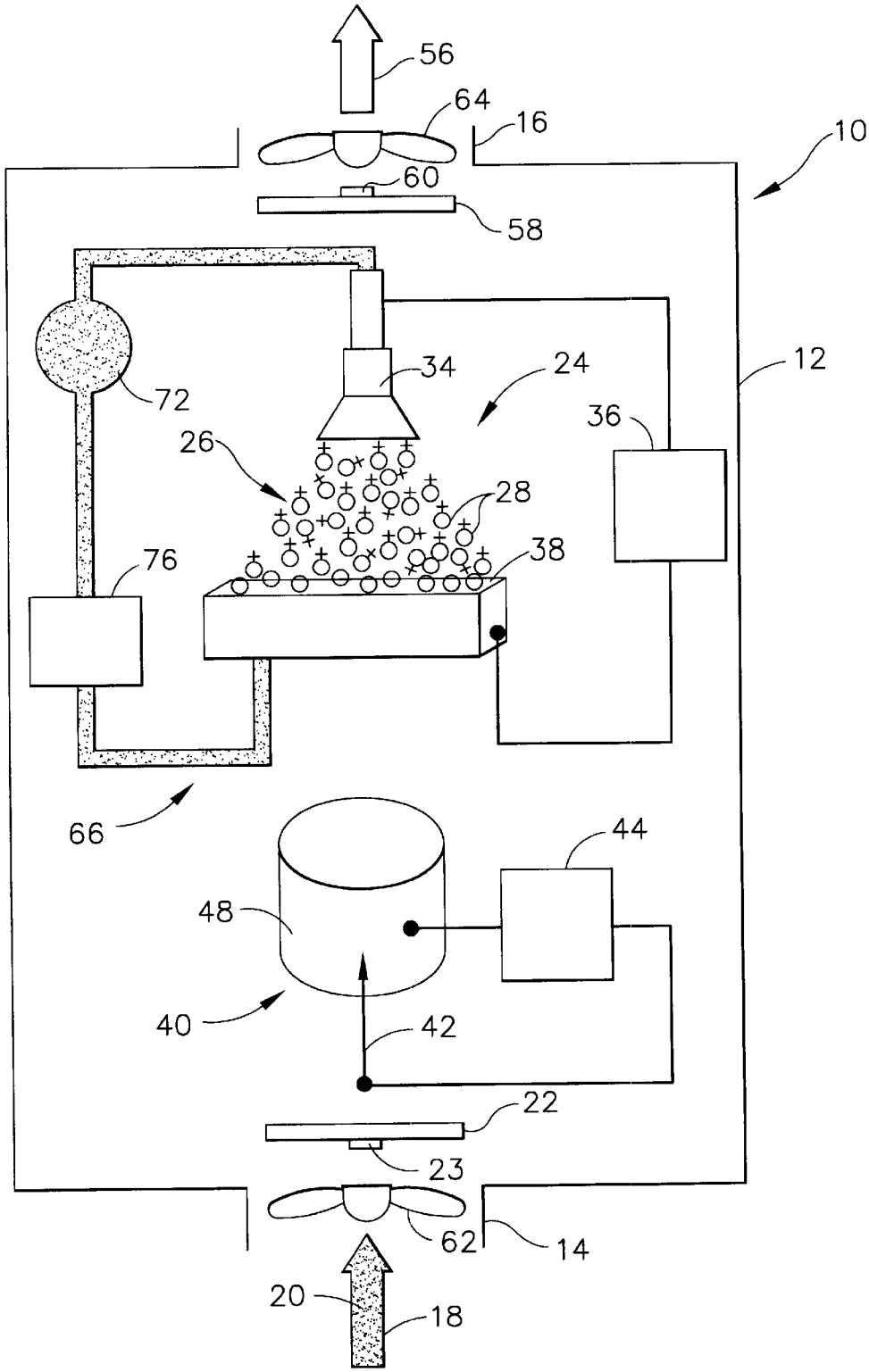
FIG. 3 is a diagrammatic view of a third embodiment for the air purification system of the present invention, where the flow of air into the system is substantially opposite to the direction of the fluid spray therein.

Regardless of the configuration for spray nozzle 34 and collecting surface 38, it will be understood that spray droplets 28 are preferably distributed in a substantially homogeneous manner within first chamber 24. It has been determined that spray droplets 28 preferably should enter first chamber 24 at substantially the same velocity as air flow 18. Spray nozzle 34 may also be oriented in different manners so that spray droplets 28 flow in a direction substantially the same as the direction of air flow 18 (see FIG. 2), substantially opposite to the direction of air flow 18 (see FIG. 3), or at an angle (e.g., substantially perpendicular) to the direction of air flow 18 (see FIG. 1). The size of spray droplets 28 is an important parameter relative to the size of particles 20. Accordingly, spray droplets 28 preferably have a size in a range of approximately 0.1–1000 microns, more preferably in a range of approximately 1.0–500 microns, and most preferably in a range of approximately 10–100 microns.

One design consideration should be the charge density that is imparted to the droplets: while a higher charging voltage at the nozzle 34 will likely further ensure that droplets will successfully be formed at the nozzle's exit, it normally is best to not use a voltage magnitude that will tend to cause the droplets to become very tiny (e.g., below 0.1 microns). Very tiny droplets may tend to be entrained in the air flow, and may thereby completely miss the "target" collecting surface 38. Of course, this would have two negative consequences: (1) such droplets would remove no particulates, and (2) the operating fluid would vanish over time. Furthermore, very tiny droplets may not be able to "grab" onto particles greater than a certain size, although very small particles would almost always be removed even by very tiny droplets.

In FIG. 1, outlet 16 of housing 12 is in flow communication with first chamber 24 so that air flow directed therethrough (designated by arrow 56) is substantially free of particles 20. A filter 58 may also be provided adjacent outlet 16 in order to remove any spray droplets 28 which are not attracted by collecting surface 38 in first chamber 24. A sensor 60 is preferably provided at outlet 16 for monitoring the quality of air flow 56 upon exiting apparatus 10. Moreover, in order to balance efficiency of apparatus 10 with the ability to substantially remove particles 20 from air flow 18, it will be appreciated that air flow 18 have a predetermined rate of flow through apparatus 10. To better maintain a desired flow rate, inlet 14 and/or outlet 16 also may include a device 62 or 64, such as a fan, to assist in pushing or drawing air flow 18 from inlet 14 through first and second chambers 24 and 32, respectively.

A control unit 50 (see FIG. 4) is provided in order to operate apparatus 10, and, more specifically, power supply 36, power supply 44, fan 62, and fan 64. Additionally, control unit 50 is connected to sensor 60 for monitoring the quality of air exiting apparatus 10 and to a sensor 76 for monitoring the quality and flow rate of fluid 30 recirculated through a fluid recirculation system 66.

It will also be seen from FIGS. 1–4 that a fluid recirculation system 66 is preferably in flow communication with collecting surface 38 so as to capture fluid 30 aggregated from spray droplets 28 and provide it back to spray nozzle 34 for continuous use. In particular, fluid recirculation system 66 includes a device for collecting fluid 30 from collecting surface 38 and a wall 67, defining first chamber 24. This fluid collection mechanism preferably is incorporated into collecting surface 38, as exemplified by the openings in the configurations depicted in FIGS. 6–9. Fluid recirculation system 66 also includes a reservoir 70 in flow communication with device for storing fluid 30 (aggregated at collecting surface 38 from spray droplets 28) and a pump mechanism 72 for providing such fluid 30 to spray nozzle 34.

It will be appreciated that fluid recirculation system 66 also preferably includes a filter 74 positioned between collecting surface 38 and spray nozzle 34 for removing particles 20 from fluid 30. This assists in keeping fluid 30 more pure and prevent possible occlusion in spray nozzle 34. A device 76 may be provided in association with filter 74 to monitor the quality of fluid 30 prior to being pumped to spray nozzle 34, whereby device 76 is able to indicate when such fluid 30 should be replaced.

Figure 5:
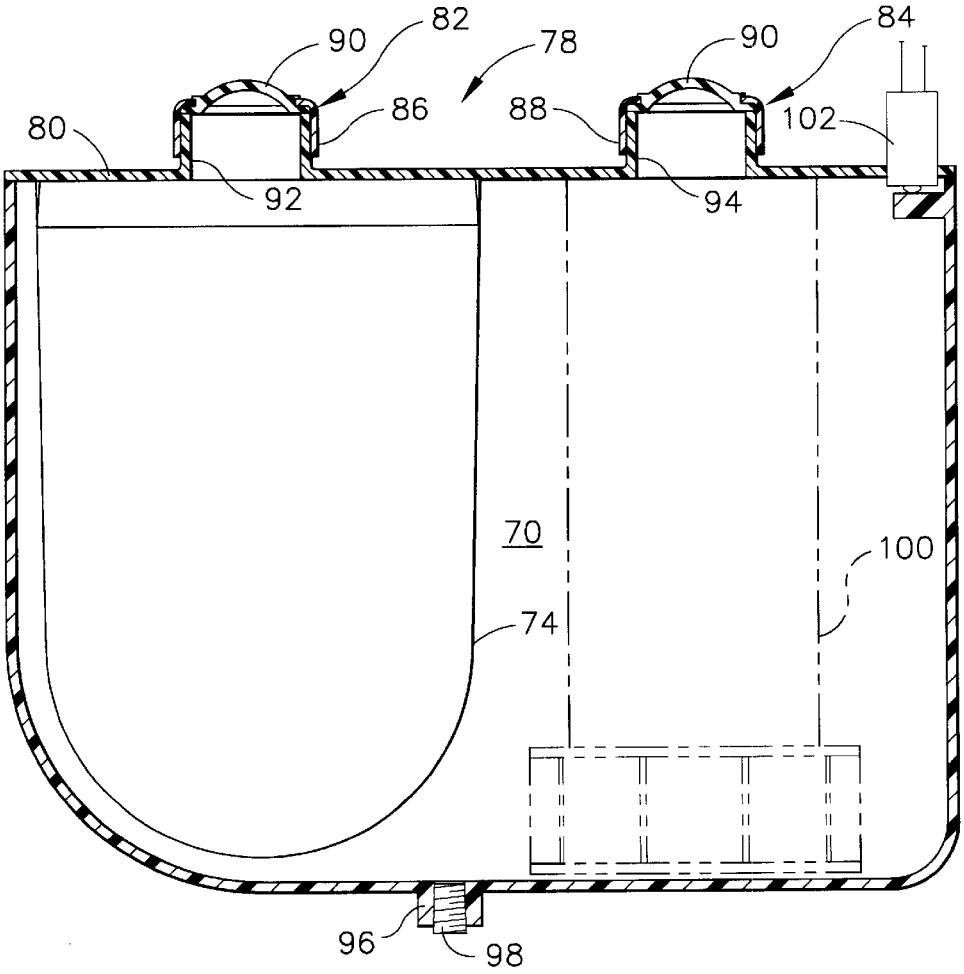
FIG. 5 is a cross-sectional view in partial cross-section of the disposable cartridge depicted in FIG. 4.
Figure 6A:
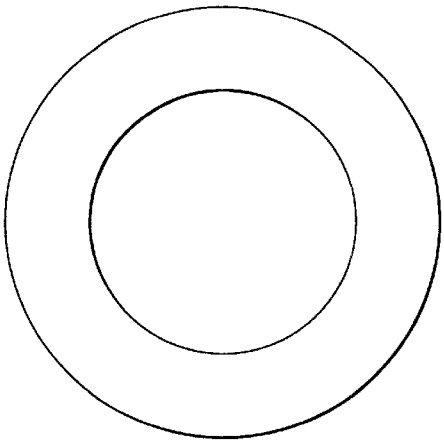
FIGS. 6A is a top view of an exemplary collecting device utilized with an axisymmetric spray nozzle in a first chamber or area of the air purification system depicted in FIGS. 1, 4 and 5.
Figure 6B:
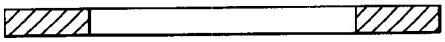
FIG. 6B is a side view in cross-section of the collecting device depicted in FIG. 6A.
Figure 8A:
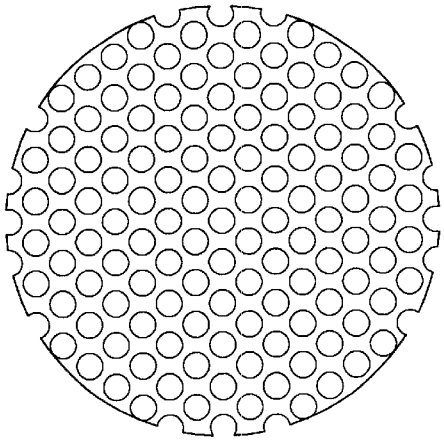
FIG. 8A is a top view of an exemplary collecting device utilized with an axisymmetric spray nozzle in a first chamber or area of the air purification system depicted in FIGS. 2 and 3.
Figure 8B:
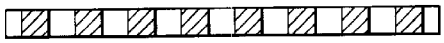
FIG. 8B is a side view in cross-section of the collecting device depicted in FIG. 8A.
Figure 7A:
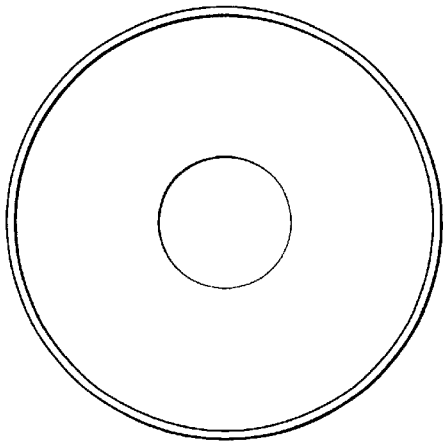
FIG. 7A is a top view of an exemplary collecting device utilized with an axisymmetric spray nozzle in a first chamber or area of the air purification system depicted in FIGS. 1, 4 and 5.
Figure 7B:
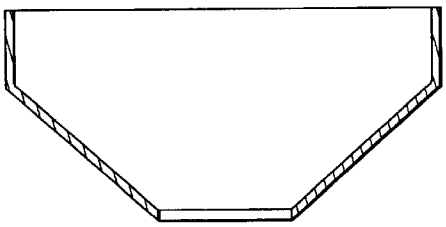
FIG. 7B is a side view in cross-section of the collecting device depicted in FIG. 7A.
Figure 9A:
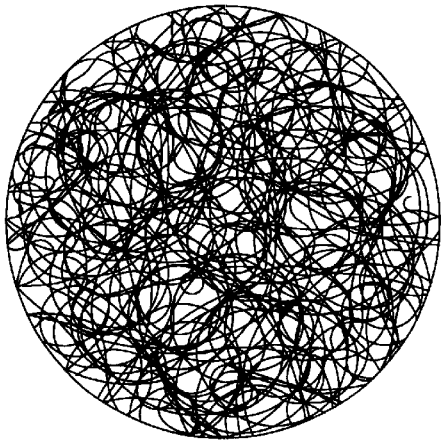
FIG. 9A is a top view of an exemplary collecting device utilized with an axisymmetric spray nozzle in a first chamber or area of the air purification system depicted in FIGS. 2 and 3.
Figure 9B:
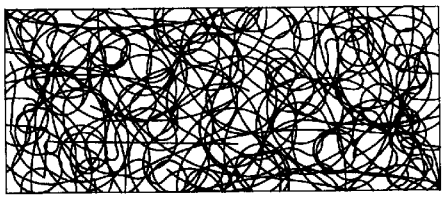
FIG. 9B is a side view in cross-section of the collecting device depicted in FIG. 9A.

In a preferred embodiment of fluid recirculation system 66 depicted in FIG. 5, a disposable cartridge 78 is utilized to house at least a portion thereof. This permits semiconducting fluid 30 used for spray droplets 28 to be easily replaced when desired. More specifically, cartridge 78 includes a housing 80 having an inlet 82 in flow communication with collecting surface 38 at a first end and reservoir 70 at a second end. An outlet 84 is also provided in cartridge housing 80 which is in flow communication with reservoir 70 at a first end and pump mechanism 72 at a second end. As seen in FIG. 5, a filter 74 may be contained within cartridge housing 80 so that fluid 30 flows therethrough prior to entering reservoir 70. Alternatively, filter 74 may be positioned so that fluid 30 first enters reservoir 70. It will be appreciated that monitoring device 76 may or may not be included within cartridge 78, but should be positioned upstream of pump mechanism 72. If provided with cartridge 78, monitoring device 76 preferably will indicate when fluid 30 therein should be replaced. Inlet 82 and outlet 84 of cartridge housing 80 each are shown to have a cap portion 86 and 88, respectively, which extends from housing 80 and preferably has a self-sealing membrane 90 covering a passage 92 and 94 through each respective cap portion.

Preferably, cartridge 78 is configured so that inlet 82 is in flow communication with fluid 30 aggregated by collecting surface 38. Indeed, a portion of housing 80 may itself function as collecting surface 38. Likewise, cartridge 78 will preferably be configured so that outlet 84 is in flow communication with spray nozzle 34 or a spray nozzle integral therewith. An opening 96 with a corresponding removable plug member 98 is preferably provided in housing 80 so that fluid 30 is permitted to be drained from reservoir 70 when considered too dirty or impure. New fluid can also be replaced in reservoir 70 by such means.

It will be appreciated that a pump (identified in phantom by reference numeral 100 in FIG. 5) may be positioned within cartridge 78 to assist in moving fluid 30 through outlet 84. It is also oppional for a switch 102 to be integrated with cartridge 78 so that apparatus 10 will not operate when a cartridge is not positioned therein. Similarly, cartridge 78 may be configured in a specified way so that only cartridges having such configuration are identified as being acceptable for use.

It has been found that apparatus 10, and particularly the size, density and charge of spray droplets 28 formed in first chamber 24 by spray nozzle 34, is preferably designed so as to satisfy an efficiency design parameter EDP within a specified range. Present experience has found that an efficiency design parameter within a range of approximately 0.0–0.6 is acceptable, while a range of approximately 0.0–0.3 is preferred and a range of approximately 0.0–0.15 is considered optimal. This efficiency design parameter is preferably calculated as a function of several parameters. The first component is a charge dependent parameter CDP calculated by the following formula when both particles 20 and spray droplets 28 are charged (i.e., K=1):

$$CDP=10^{aL+bL-cL-dL+25.45}$$

When only spray droplets 28 are charged (K=−1), then the charge dependent parameter is preferably calculated by the following:

$$CDP=[(10^{2*aL+2*bL-PL-dL+18.26})^{0.4}]+1$$

where a=charge per unit area of the electrostatically sprayed particles 20 (units of coulombs per square centimeter)

b=charge of particles 20 to be collected (units of coulombs)

c=diameter of particles 20 to be collected (units of microns)

d=relative velocity between particles 20 and spray droplets 28 (units of meter per second)

P=diameter of spray droplets 28 (units of microns) It will be appreciated that aL, bL, cL, dL and PL are the logarithms of the aforementioned respective variables.

A second component of efficiency design parameter EDP is a dimensionless parameter $N_D$ which is preferably calculated according to the following formula:

$$N_D = P^3Q/(-1.910\times10^{12}+P^3Q)$$

where

P=diameter of spray droplets 28 (units of microns)

Q=number of spray droplets 28 (units of particles per centimeter cubed)

The efficiency design parameter EDP is then preferably determined from the following equation:

$$EDP = \exp[(N_D\times CDP\times W\times 38100)/(P\times Z)]$$

where $N_D$=dimensionless parameter

CDP=charge dependent parameter (dimensionless)

W=linear distance in direction of air flow 18 from the point the air first contacts the spray to the point where air exits the spray (units of inches)

P=diameter of spray droplets 28 (units of microns)

Z=a velocity dependent parameter (dimensionless)

It will be appreciated that velocity dependent parameter Z is equal to one when air flow 18 moves in either substantially the same direction as or substantially opposite to the flow direction of spray droplets 28. Should the flow of spray droplets 28 be at an angle to air flow 18, velocity dependent parameter Z is determined as:

$$Z = \cos[\arctan(V_2/V_1)].$$

In order to appreciate better how calculation of efficiency design parameter EDP is performed, an exemplary calculation is determined where removal of 1 micron aerosol particles from an air flow using a spray of electrostatically charged 10 micron spray droplets having a density of 500 particles/cm$^3$ is desired. The aerosol particles enter the spray in air that has a speed of 2.1 meters per second. The spray droplets travel to collecting surface 38 at a speed of 2 meters per second and their travel is in the same direction as air flow 18. The aerosol particles 20 are corona charged in second chamber 40 prior to entering spray 26 and have a charge of $6\times10^{-17}$ coulomb. Electrostatically charged spray droplets 28 have a charge per unit area of $9.5\times10^{-9}$ coulomb per square centimeter and spray 26 extends over a distance of 2 inches.

With regard to the information supplied for the example above,

| | |
|---|---|
| P = 10 | PL = 1.0 |
| Q = 500 | |
| W = 2 | |
| Z = 1 | |
| a = $1.7\times10^{-8}$ C/cm$^2$ | aL = −7.77 |
| b = $6\times10^{-17}$ C | bL = −16.22 |
| c = 1 $\mu$m | cL = 0 |
| d = 0.1 m/s | dL = −1 |
| K = +1 | |
| CDP = $10^{aL+bL-cL-dL+25.45}$ = 281 | |
| $N_D$ = $-2.62\times10^{-7}$ | |
| EDP = exp [{(−2.62 × $10^{-7}$) × (281) × (2) × 38100} / {(10) × (1)}] = 0.57 | |

While the design in the aforementioned example is considered to be within an acceptable range, it will be seen that modifications to such example where the spray density is 2000 particles per centimeter cubed and the spray droplets are 30 microns in size enable the charge dependent parameter CDP to be 162 and the dimensionless parameter $N_D$ to be $-2.83\times10^{-5}$. Accordingly, the efficiency design parameter EDP is calculated as being equivalent to $9\times10^{-5}$, which is considered to be in the optimum range.

With regard to semiconducting fluid 30 utilized with the present invention, such fluid is preferably non-aqueous in order that spray droplets 28 formed therefrom are able to sustain the applied charge for a sufficient residence time (i.e., before striking collecting surface 38). Additionally, such fluid 30 should preferably be inert, non-volatile and non-toxic for obvious safety reasons. It has been found that such fluid should exhibit certain physical characteristics which enable it to be formed into spray droplets 28 of the desired size, provide the desired spray coverage within first chamber 24, and function effectively in attracting and retaining particles 20 as determined by calculation of the efficiency design parameter EDP.

Taking into account the desired functionality of fluid 30 as spray droplets 28, a formulation has been determined which measures what is known herein as a sprayability factor SF for a given fluid. First, a characteristic length CL of the fluid is determined from the following:

$$CL = [\{(PFS)^2\times(ST)\}/\{(D)\times(1/R)^2\times(10^7)\}]^{1/3}.$$

Next, a characteristic flow rate CFR of the fluid is determined from the following:

$$CFR = [\{(PFS)\times(ST)\}/\{(D)\times(1/R)\times(10^5)\}]$$

and a property dependent parameter PDP is determined from the following:

$$PDP = [\{(ST)^3\times(PFS)^2\times(6\times10^3)\}/\{(V)^3\times(1/R)^2\times(FR)\}]^{1/3}.$$

Then, should the property dependent parameter PDP be less than 1, the sprayablility factor SF is calculated from the following equation:

$$SF = [\log(CL)+\log[(1.6)\times((RDC)-1)^{1/6}\times[(FR)/\{(CFR)\times(6\times10^7)\}]^{1/3}-((RDC)-1)^{1/3}]].$$

If the property dependent parameter PDP is greater than 1, the sprayability factor SF is calculated from the following equation:

$$SF = -[\log(CL)+\log[(1.2)\times\{[(FR)/\{(CFR)\times(6\times10^7)\}]^{1/2}\}-0.3]$$

It will be understood that the parameters identified in the above equations are as follows:

FR =flow rate (units of milliliters per minute)

D=density of liquid (units of kilograms per liter)

RDC=relative dielectric constant of fluid (dimensionless)

R=resistivity (units of ohm centimeters)

ST=surface tension of fluid (units Newtons per meter)

PFS=permittivity of free space (units of F/m)

V=viscosity of the liquid (units of Pascuals)

In conjunction with the above formulas, it has been found that an acceptable range for the sprayability factor SF is approximately 2.4–7.0, a preferred range for the sprayability factor SF is approximately 3.1–5.6, and an optimal range for sprayability factor SF is approximately 4.0–4.9.

In order to better appreciate the calculation of sprayability factor SF, an exemplary calculation follows for the spraying of propylene glycol (PG) at a flow rate of 0.3 mL/min. Propylene glycol has a density of 1.036 kg/L, a viscosity of 40 mPas, a surface tension of 38.3 mN/m, a resistivity of 10

Megaohm cm and a dielectric constant of 32. According to the foregoing equations, the characteristic length CL is calculated to be $3.045\times10^{-6}$, the characteristic flow rate CFR is calculated to be $3.19\times10^{-11}$, and the property dependent parameter PDP is calculated to be $5.03\times10^{-2}$. Since the PDP is less than one, the first equation for the sprayability factor SF is utilized and is determined to be 4.4 (in the optimal range). It will be appreciated that if the flow rate is increased to 3 mL/min, the sprayability factor SF is calculated to be 4.0, which is still within the optimal range of values.

In accordance with the above formulation, it has been found that preferred ranges for the indicated parameters are: viscosity of the fluid (V) has a range of approximately 1–100 milliPascals; surface tension of the fluid (ST) has a range of approximately 1–100 milliNewtons per meter; resistivity of the fluid (R) has a range of approximately 10 kilohm–50 Megaohm and a preferred range of approximately 1–5 Megahom; and the electric field (E) is approximately 1–30 kilovolts per centimeter. The relative dielectric constant of fluids (RDC) preferred range is from 1.0 to 50.

Upon consideration of the above formulations and the requirements of fluid 30 to be utilized as spray 26, it has been found that the following class of fluids may be utilized: oils, silicones, mineral oil, cooking oils, polyols, polyethers, glycols, hydrocarbons, isoparafines, polyolefins, aromatic esters, aliphatic esters, fluorosurfactants, and mixtures thereof.

Of such fluids, it is preferred that the following types be utilized in apparatus 10: glycols, silicones, ethers, hydrocarbons and their substituted or unsubstituted oliogomers with molecular weight less than 400, and mixtures thereof. More preferred are the following: diethylene glycol monoethyl ether, triethylene glycol, tetraethylene glycol, tripropylene glycol, butylene glycol, and glycerol. It has also been found that certain mixtures containing such fluids is preferred in the following amounts: (1) 50% propylene glycol, 25% tetraethylene glycol, and 25% dipropylene glycol; (2) 50% tetraethylene glycol and 50% dipropylene glycol; (3) 80% triethylene glycol and 20% tetraethylene glycol; (4) 50% tetraethylene glycol and 20% 1,3 butylene glycol; and (5) 90% dipropylene glycol and 10% transcutol CG (diethylene glycol monomethyl ether).

Figure 19:
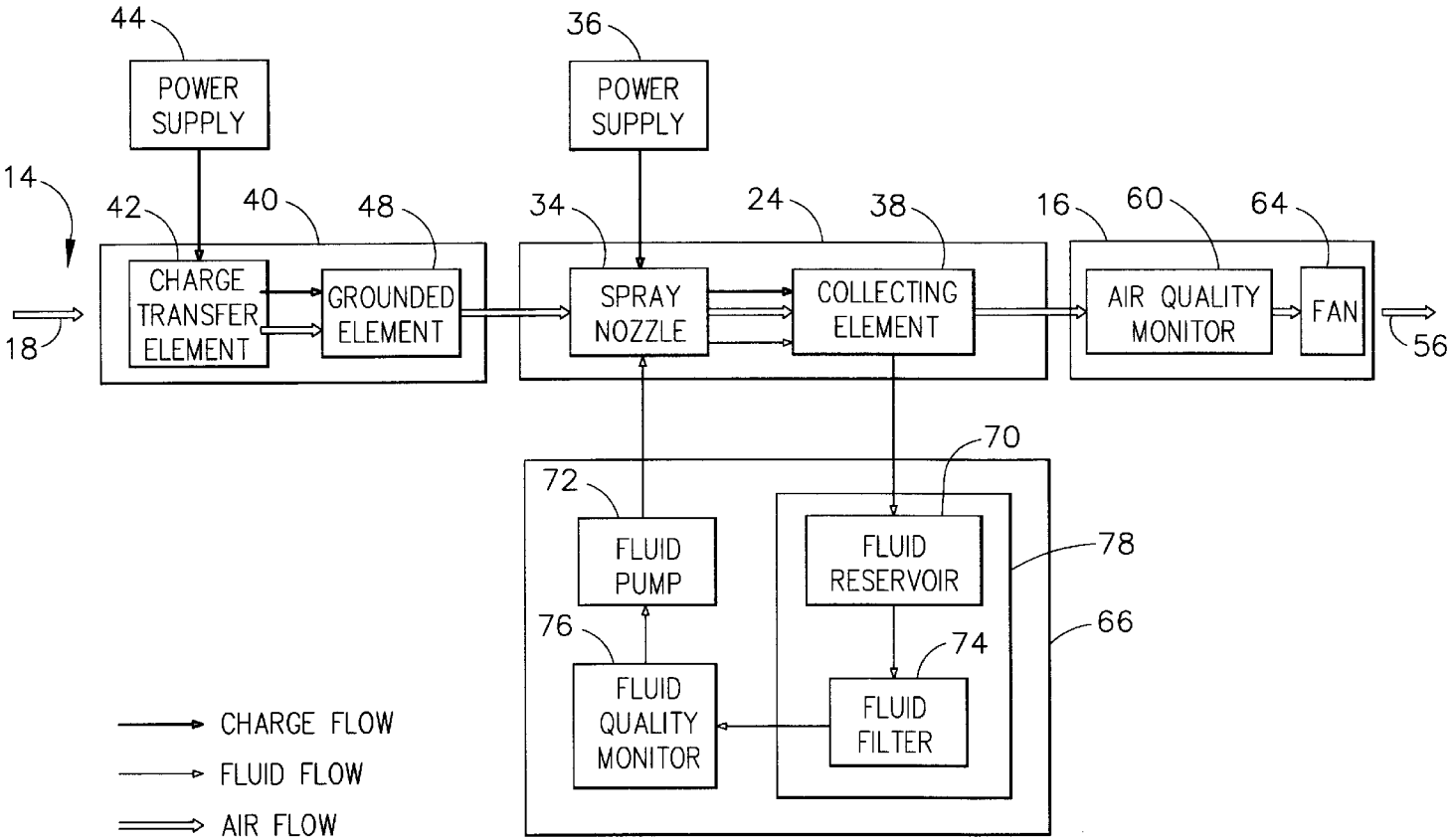
FIG. 19 is a block diagram of the air purification system depicted in FIGS. 1–4, where the flow of air, fluid and charge is indicated therein.

In order to better appreciate the process of the present invention, the charge flow, fluid flow, and air flow within apparatus 10 are depicted in FIG. 19 by arrows of the following convention: bold arrows indicate charge flow; solid arrows indicate fluid flow; and, expanded arrows indicate air flow. In the preferred embodiment, it will be seen that air flow 18 passes through inlet 14 into second chamber 40, where particles 20 therein are charged at a desired polarity. Such air flow 18 is preferably filtered at inlet 14 by filter 22 so that particles therein having a size greater than about 10 microns are separated therefrom prior to entering second chamber 40. Air flow 18 may also be caused to have a turbulence within second chamber 40 so as to enhance the charging of particles 20. Air flow 18 then enters first chamber 24 and interfaces with spray droplets 28 therein so that particles 20 are electrostatically attracted thereto and removed from air flow 18. Finally, air flow 56 exits first chamber 24 and flows through outlet 16. Air flow 56 may again be filtered by filter 58 and the quality thereof is monitored by sensor 60 so as to determine the effectiveness of apparatus 10.

With regard to charge flow, it will be seen from FIG. 19 that a charge having a desired polarity (opposite to that of spray droplets 28) is provided to particles 20 in second chamber 40 by means of charge transfer element 42 and power supply 44. A charge having a polarity opposite that of the charge placed on particles 20 is provided to fluid 30 or spray droplets 28 by spray nozzle 34 and power supply 36 either before or after formation of spray droplets 28. Particles 20 are then attracted to spray droplets 28 and carried to collecting surface 38 in first chamber 24, whereupon the respective charges on particles 20 and spray droplets 28 are neutralized.

It will be seen in FIG. 19 that semiconducting fluid 30 is provided to spray nozzle 34 so that spray droplets 28 are formed and provided into first chamber 24 as spray 26. Thereafter, spray droplets 28 are attracted to collecting surface or element 38, where they are preferably collected to form a fluid aggregate and recirculated to spray nozzle 34 via fluid recirculation system 66. This involves fluid 30 being collected in reservoir 70 and provided to spray nozzle 34 by pump mechanism 72. As shown in FIG. 19, it is preferred that such fluid 30 have particles 20 filtered therefrom by filter 74 and the quality of such fluid 30 monitored by fluid quality monitor device 76 prior to entering pump mechanism 72.

One of the characteristics of air filters is the permeability, which as described above represents a percentage of the void divided by the percentage of the volume of a filter medium. In the present invention, the permeability is typically greater than 97%. This compares very favorably with that of a HEPA filter, in which the permeability is less than 1%. It is thus easy to see why the present invention has a much lower backpressure characteristic than any type of HEPA filter at the same air velocity through the filter.

Another important aspect of the present invention is its very low noise which is generated by the fan blowing air therethrough. Since the backpressure is relatively insignificant in the present invention, the noise of the fan and its associated motor will typically be in the range of 30–40 dB. For small installations, this noise specification would even be less. In situations where the present invention is installed in the inlet or outlet of a furnace for a home, then there would be no separate fan/motor set required, and the blower fan for the furnace or air conditioner would be all that is required. The backpressure (or pressure drop) specification for the present invention would compare very favorably with that of conventional electrostatic air filters that are also installed in furnaces or air conditioners for homes.

The present invention can use virtually any type of nozzle, although one preferred nozzle would be the size of a capillary, in which a plurality of such nozzles would be used for the nozzle unit 34. The droplets can be formed in various sizes, although the size of the actual capillary is not necessarily determinative of the droplet size. Once the droplets are formed with an electrostatic charge on their surface, they will tend to travel very quickly between the nozzle and the collector element 38. If the distance between the nozzle 34 and the collector element 38 is, for example, about four inches, then it is preferred that the droplets travel the entire four inch-distance before the electrical charge is dissipated. It is best if the travel time is in the order of magnitude of several tenths of a second maximum, and therefore, the fluid used to create the droplets should have a relaxation time that is in the same order of magnitude. It would be preferred for the relaxation time specification of the fluid to be at least several tenths of a second, or even as much as one second. Thus a semiconductive fluid is preferred, as discussed above.

The present invention truly acts as a "dynamic" liquid electrostatic filter. As the liquid is recirculated, its surface (as droplets) is renewed and it will continue to attract dust or dirt particles by virtue of its electrostatic charge on the surface, even after each of the droplets has already received other dirt or dust particles from earlier operation of the unit. It will take a fairly lengthy amount of time before the semiconductive fluid is finally saturated with dirt or dust such that it would become less effective. For one of the preferred fluids, the time frame by which the filter could be continuously used before becoming saturated with dirt or dust particles is on the order of 4–6 months of continuous operation.

Another beneficial characteristic of the present invention is that its operation as an air filter does not substantially change the air temperature or the air humidity as the air is being cleaned when it passes through the filter. This is quite the opposite of some military air filters that literally incinerate the incoming air at 3000° F., after which that air has to be substantially cooled before being permitted to recirculate back into the spaces where humans are operating.

As will be seen below, the air cleaner of the present invention compares favorably with both electrostatic precipitator-type air filters and with HEPA-type filters. In fact, the present invention substantially fills the void between these two extremes of air filter types by operating successfully between the backpressure specifications and the cleaning efficiency specifications of electrostatic air filters and HEPA air filters.

While many electrostatic air filters are rated at an air velocity of about 500 fpm (feet per minute), they have a pressure drop typically greater than 0.2 inches of water column when cleaning particles at about 0.3 microns in size. As described above, the cleaning efficiency of such electrostatic air filters is typically 70% or less under these conditions. In contrast, the present invention can operate at an air velocity of 500 fpm (which is equal to about 2.54 meters per second) and will generate a backpressure of much less than 0.2 inches of water column with a cleaning efficiency that is greater than 70% when cleaning particles of 0.3 microns in size in the inlet air.

Electrostatic air filters will typically show a greater air cleaning efficiency when used with the ASHRAE dust spot test such that, at the same 500 fpm air velocity, the cleaning efficiency will typically be around 84% at a lower backpressure, as compared to using particles of 0.3 microns in size. The present invention nevertheless compares favorably, and under the conditions of an ASHRAE dust spot test, the present invention will have a cleaning efficiency much greater than 85% at a backpressure of less than 0.1 inches of water column when the air velocity is 2.54 meters per second (equal to 500 fpm).

Another important characteristic of the present invention is that its air cleaning efficiency specification will not substantially decrease for several months, which is in complete contrast to electrostatic air cleaners whose air cleaning efficiency drops off significantly under similar operating time periods, sometimes dropping off significantly after only a few days of operation. Moreover, the present invention will not increase its backpressure characteristic by a significant amount over several months of operation. Typically, the backpressure and air cleaning efficiency characteristics change by less than 10% over sixty days of continuous operation of the air cleaner of the present invention.

With regard to HEPA filters, they are typically rated at an air velocity of about 90 fpm (which is equal to 0.4572 meters per second), with a dirt or dust particle size of 0.3 microns diameter, and at a cleaning efficiency of 99.97%. Most HEPA filters at this air velocity have a backpressure that is greater than one inch of water column. In contrast, the present invention can operate at an air velocity of 90 fpm, at a cleaning efficiency of substantially 99.97% with particle sizes of 0.3 microns, and the backpressure will be less than 0.8 inches of water column. On top of this, the air moving through the filter of the present invention will not substantially change as to its temperature and humidity characteristics.

In an alternative embodiment of the present invention, solid "beads" instead of liquid droplets can be projected from a "spray" nozzle into a "mixing chamber" such as the first chamber 24 to impact or come within close proximity of particles in incoming air. These solid beads could be electrostatically charged just before they are output from some type of spray nozzle or plurality of spray nozzles, such as the element 34 in FIG. 1. These solid beads would be of an electrically semiconductive material or an insulative material so that they could be electrostatically charged and retain that charge until the beads reach a collecting surface, or more appropriately a collecting box or trough, instead of a flat collecting surface such as the surface 38 in FIG. 1.

When using the solid beads as the electrostatically charged material that will attract the dirt or dust particles from the incoming air, the system would not be a recirculating system, but instead would be more useful as a "one-time" use or "single-use" system for cleaning air. When the solid beads have been accumulated in a collecting trough or box (or any other type of chamber), then these solid beads could be disposed of. This would be particularly useful for removing some type of sub-micron size of dangerous microbes or biohazardous materials from the air.

It is contemplated by the inventors that such a system of cleaning biohazardous or otherwise dangerous particles from air would be very useful in hospitals or in military installations, and that sufficient numbers of solid beads would be supplied so that a particular room could be sealed off, the air cleaning system started, and then the solid beads dispensed through the nozzles 34 at a high rate (and high density) for a sufficient number of minutes until virtually all of the air in the room had been circulated at least two or three times, thereby removing the biohazard.

Figure 20:
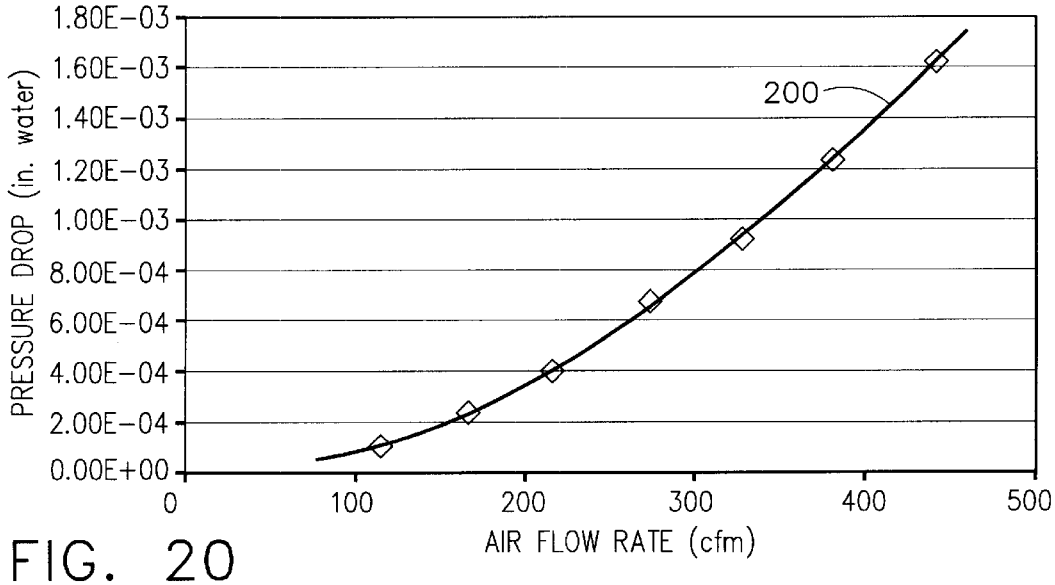
FIG. 20 is a graph of pressure drop vs. air flow rate using computer modeling data of a 10 inch×4 inch×2 inch air cleaner constructed according to the principles of the present invention.

The present invention has been tested both in prototypical form and using computer modeling. Some of the test data from the computer modeling scenario is presented in FIGS. 20–23, in which a filter having dimensions of about 10 inches×4 inches×2 inches was the test subject. FIG. 20 illustrates a graph of pressure drop in inches of water column versus airflow rate in cubic feet per minute. With a filter cross-section of 10 inches×4 inches, 100 cfm is equivalent to 360 fpm (feet per minute) air velocity, 200 cfm is equal to 720 fpm, 300 cfm is equal to 1080 fpm, and 400 cfm is equal to 1440 fpm.

In FIG. 20, the curve 200 shows the pressure drop at these airflow rates as indicated, and it is important to note that this computer-modeled data refers to the pressure drop across the filter element itself, and does not include any additional pressure drops due to ducting, or inlet and outlet configurations, above those of the filter itself. Of course, the use of the term "filter media" in the present invention essentially refers to the first chamber 24, as seen on FIG. 1, for example. In other words, there is no solid filter media involved, but instead the filter media consists of an open chamber or volumetric space that has liquid droplets passing therethrough.

The computer modeled data of FIG. 20 used a charged droplet size of 30 microns diameter, and a droplet density of 3,000 drops per cubic centimeter.

Figure 21:
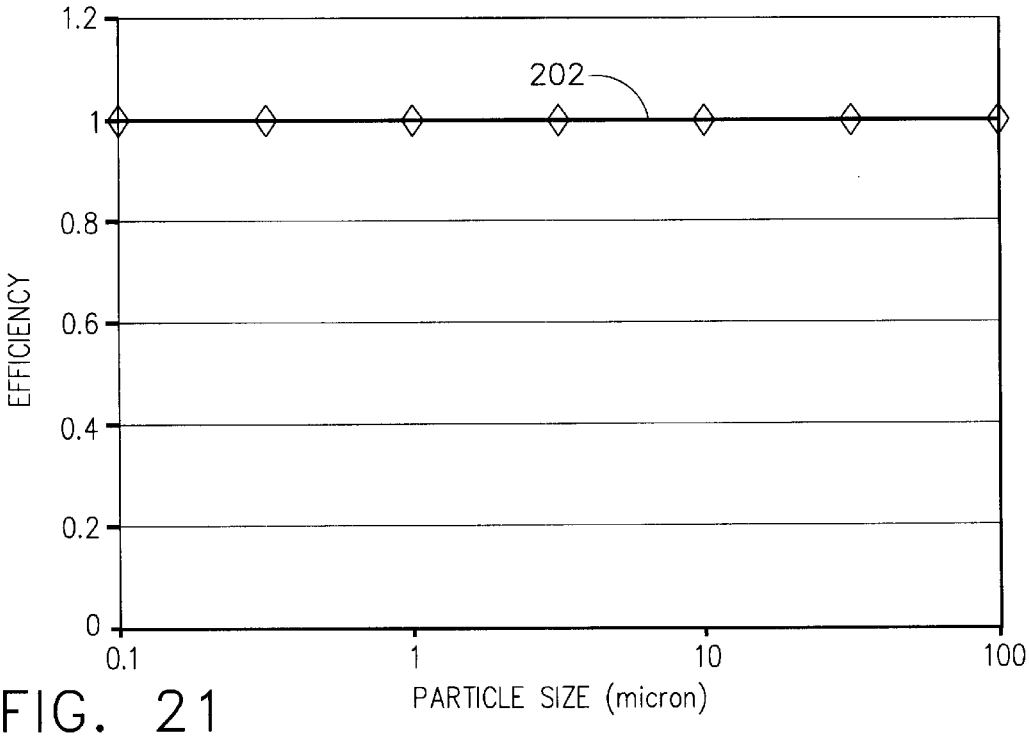
FIG. 21 is a graph of air cleaning efficiency vs. particle size using computer modeling data of a 10 inch×4 inch×2 inch air cleaner constructed according to the principles of the present invention.

FIG. 21 is a chart showing the air cleaning efficiency versus particle size of the particulate matter that is entrained in the incoming air. The curve 202 indicates that the efficiency is nearly 100% using a particle size in the range of 0.1 microns through 100 microns. HEPA filters are tested at 0.3 micron particle size, while electrostatic precipitator-type filters are tested at certain particle sizes (such as 0.3 microns), or are more often tested using the ASHRAE dust spot test.

Figure 22:
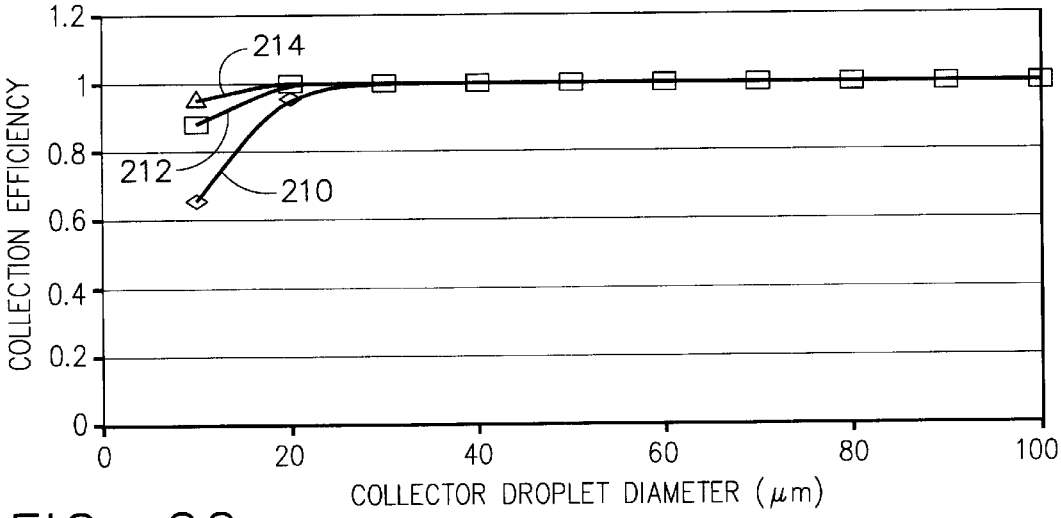
FIG. 22 is a graph of air cleaning efficiency vs. collector droplet diameter using computer modeling data of a 10 inch×4 inch×2 inch air cleaner constructed according to the principles of the present invention.
Figure 23:
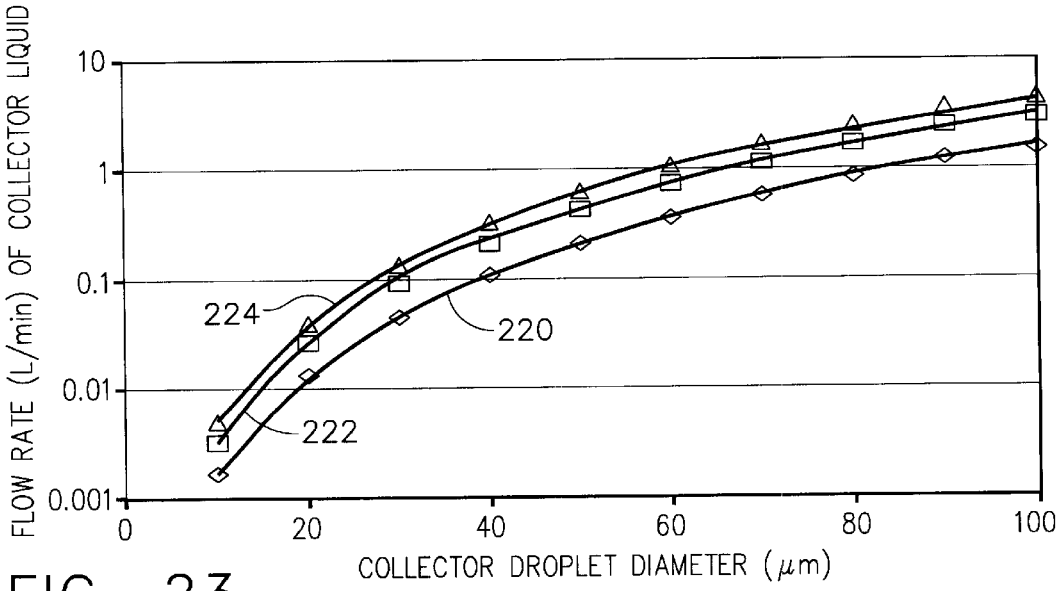
FIG. 23 is a graph of collector liquid flow rate vs. collector droplet diameter using computer modeling data of a 10 inch×4 inch×2 inch air cleaner constructed according to the principles of the present invention.

FIGS. 22 and 23 are further data from the computer modeling used with the present invention. This is an example of the present invention used as a room air cleaner, in which the air velocity through the filter (i.e., the first chamber 24) is 2.1 meters per second (which translates to an air velocity of about 414 fpm), and a droplet velocity being discharged from the spray nozzle 34 of 2.0 meters per second (about 394 fpm). The filter size is again 10 inches×4 inches×2 inches, so at this air velocity of 2.1 meters per second, the clean air delivery rate (CADR) is approximately 110 cfm (cubic feet per minute).

Referring now to FIG. 22, the graphs 210, 212, and 214 represent different densities of droplets per cubic centimeter. Graph 210 is 1,000 droplets per cubic centimeter (cc), while graph 212 is 2,000 droplets per cc and graph 214 is 3,000 droplets per cc. The Y-axis represents the "cloud collection efficiency" (i.e., the air cleaning efficiency), while the X-axis represents the "collector droplet diameter" in microns. As can be seen from FIG. 22, the denser the number of droplets, the greater the efficiency when the droplet diameter is less than 30 microns. However, if the droplet diameter is greater than 30 microns, the efficiencies are essentially equal regardless of the density of droplets. Of course, the greater the density of droplets, the more liquid that must be discharged through the spray nozzle 34 per unit of time.

FIG. 23 has corresponding curves 220, 222, and 224 which represent different numbers of droplets per cubic centimeter. Curve 220 represents 1,000 droplets per cc, while curve 222 is for 2,000 droplets per cc and curve 224 is for 3,000 droplets per cc. The Y-axis is the "flow rate" in liters per minute of the liquid being passed through the spray nozzle 34, while the X-axis represents the "collector droplet diameter" in microns.

As can be seen in FIG. 23, the greater the density of droplets per volume, the greater the flow rate, which of course must be true. As the collector droplet diameter decreases, then so does the flow rate, even if the density of droplets is maintained at a constant value.

Further information not found in the graphs of FIGS. 20–23 is provided below in tabular form. In the first example, the computer modeling data for the present invention shows particle diameter (in meters), particle collection efficiency, and particle "escapees" (which in essence is "1—collection efficiency") for a duct air velocity of 5 meters per second (about 984 feet per minute), at three different droplet densities. The 5 meter/second air velocity in a duct is typical for whole house HVAC systems. This data is provided in three different tables, referred to herein as TABLES #1 through #3, for drop densities of 1000 drops per cc, 2000 drops per cc, and 3000 drops per cc, respectively.

TABLE #1

| 5 m/s Air Velocity (typical home duct velocity) 1000 drops/cc | | |
|---|---|---|
| Particle diameter (m) | Efficiency | Escapees |
| 1.00E−07 | 0.135700000000 | 0.8643 |
| 5.00E−07 | 0.517700000000 | 0.4823 |
| 1.00E−06 | 0.767400000000 | 0.2326 |

TABLE #1-continued

| 5 m/s Air Velocity (typical home duct velocity) 1000 drops/cc | | |
|---|---|---|
| Particle diameter (m) | Efficiency | Escapees |
| 5.00E−06 | 0.999300000000 | 0.0007 |
| 1.00E−05 | 0.999999537000 | 4.63E−07 |
| 3.00E−05 | 1.000000000000 | 2.12E−32 |

TABLE #2

| 5 m/s Air Velocity (typical home duct velocity) 2000 drops/cc | | |
|---|---|---|
| Particle diameter (m) | Efficiency | Escapees |
| 1.00E−07 | 0.253000000000 | 0.747 |
| 5.00E−07 | 0.767440000000 | 0.23256 |
| 1.00E−06 | 0.945900000000 | 0.0541 |
| 5.00E−06 | 0.999999537000 | 4.63E−07 |
| 1.00E−05 | 1.000000000000 | 2.19824E−14 |
| 3.00E−05 | 1.000000000000 | 0 |

TABLE #3

| 5 m/s Air Velocity (typical home duct velocity) 3000 drops/cc | | |
|---|---|---|
| Particle diameter (m) | Efficiency | Escapees |
| 1.00E−07 | 0.354400000000 | 0.6456 |
| 5.00E−07 | 0.887800000000 | 0.1122 |
| 1.00E−06 | 0.987400000000 | 0.0126 |
| 5.00E−06 | 0.999999999969 | 3.15E−11 |
| 1.00E−05 | 1.000000000000 | 0 |
| 3.00E−05 | 1.000000000000 | 0 |

Tables #1 through #3 can be compared to conventional electrostatic precipitators, and it can be seen that the cleaning efficiency of the present invention is quite high in comparison to known prior art electrostatic precipitators, especially when the droplet density is at 3000 drops/cc. The cleaning efficiency of the present invention is also superior at particle sizes of one micron or larger, even when the droplet density is only at 1000 drops/cc.

As discussed above, the conductivity of the fluid used to create the charged droplets is an important property for use in the present invention. The higher the conductivity, the easier it is for the droplets to initially be charged with an electrical voltage; however, the lower the fluid conductivity, the greater the charge "lifetime," which is technically referred to as the "relaxation time."

If the conductivity of the fluid has a value of $10^{-12}$ $Ohm^{-1}$-$meter^{-1}$, then the relaxation time is approximately 18 seconds. On the other hand, if the conductivity is increased to a value of $6.7\times10^{-10}$ $Ohm^{-1}$-$meter^{-1}$, then the relaxation time is reduced to approximately 3 milliseconds. For the purposes of the present invention, it is preferred that the relaxation time is at least several tenths of a second, and more preferably greater than one second.

In the example computer-modeled simulation illustrated in FIGS. 22 and 23, the droplet velocity was 2 meters per second, which would allow a fairly large chamber for collecting particles from inlet air if the relaxation time was at least one second. Of course, in this simulation model, the distance through the "media" was only 2 inches, so the relaxation time could of course be much less, while the charged droplet nevertheless retained its charge throughout its travel from the nozzle to the collecting plate.

As noted in a related application, the liquids used for the present invention will preferably have a relatively low viscosity, and will have a conductivity less than $10^4$ $Ohms^{-1}$ $m^{-1}$. The conductivity will preferably be even less than this $10^{-4}$ value, and a better number would be less than $10^{-10}$ $Ohm^{-1}$ $m^{-1}$. This would provide a greater relaxation time, of greater than 0.1 seconds.

It will be understood that the cleaning efficiency is equal to the number of particles entrained in the inlet air minus the number of particles entrained in the outlet air, divided by the number of particles entrained in the inlet air, and this quantity is multiplied by 100%. A particle counter is typically used when measuring actual particle counts in experimental prototypes or production units.

As noted above, a new characteristic called "pressure adjusted efficiency" (PAE) is introduced herein for describing the efficiencies and pressure drop characteristics of an air cleaning filter. The PAE is measured as the cleaning efficiency (in percent) divided by the pressure drop (in inches of water), leading to a numerical result that has the units of the inverse of pressure. In this patent document, the units will always be the inverse of inches of water column.

For a "fresh" filter, the PAE will typically be at its maximum value, and as the filter is used, the cleaning efficiency will drop while the pressure drop will tend to increase, thereby lowering the PAE numeric result. HEPA filters when "fresh" will tend to have a PAE value around 100, which would be 99.97% divided by about 0.1 inches of water column of backpressure. Of course, this backpressure tends to increase rather quickly once particulate matter is accumulated in the filter media, and the PAE accordingly will drop proportionally.

Electrostatic precipitator-type air filters tend to have much greater PAE values, mainly because the pressure drop is so much smaller while the efficiency still remains relatively high, usually at least in the range of 70–80% for the ASHRAE dust spot test.

The present invention can achieve PAEs substantially larger than any HEPA filter, while nevertheless removing sub-micron particles from air at the same efficiencies (i.e., at 99.97%).

The present invention can also achieve PAE values that are substantially similar if not greater than those achieved by conventional electrostatic precipitator-type air filters. Moreover, the PAE value for the present invention will not substantially change over extended use in the range of, for example, 2 months of continuous operating time. However, conventional electrostatic precipitators will substantially lose cleaning efficiency over the same operating time, as their collecting elements begin accumulating particulate matter, which thereby decreases the likelihood that further particulate matter will be attracted to electrically charged elements. For example, the present invention will continue to operate at a PAE that does not deviate by more than 25% after two months of continuous use.

The present invention can clean air at an efficiency greater than 70% with a backpressure of less than 0.2 inches of water column for particles substantially 0.3 microns in size at an air velocity of 500 fpm (2.54 meters per second). When using the ASHRAE dust spot test, the present invention can provide a cleaning efficiency of greater than 85% at a backpressure of less than 0.1 inches of water column at the same air velocity.

When operated at air velocities substantially similar to those of HEPA filters, the present invention can achieve a cleaning efficiency of at least 99.97% at a backpressure of less than 0.8 inches of water column with the air velocity of 90 fpm (0.4572 meters per second) when the particle size is 0.3 microns.

Another example of tabular information is provided below in reference to TABLE #4. Computer modeling data of the present invention for a filter operating at an air velocity of 0.03 meters per second (about 5.9 feet per minute) is set forth in TABLE #4, which provides a direct comparison to conventional HEPA filters. Even when the droplet density is only at 1000 drops per cc, the collecting efficiency is extremely high in TABLE #4, and in fact it is so high at particle sizes above 5 microns that the precision of the measurement cannot provide a number below 100% collecting efficiency.

TABLE #4

| 0.03 m/s Air Velocity (HEPA comparison) 1000 drops/cc | | |
|---|---|---|
| Particle diameter (m) | Efficiency | Escapees |
| 1.00E−07 | 0.999999999995 | 5.00E−12 |
| 5.00E−07 | 1.000000000000 | 3.45E−57 |
| 1.00E−06 | 1.000000000000 | 1.19E−113 |
| 5.00E−06 | 1.000000000000 | 0.00E+00 |
| 1.00E−05 | 1.000000000000 | 0.00E+00 |
| 3.00E−05 | 1.000000000000 | 0.00E+00 |

The foregoing description of a preferred embodiment of the invention has been presented for purposes of illustration and descrippion. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An air cleaning apparatus, comprising:

a chamber into which a flow of input air is directed, said input air containing a plurality of particles, said input air becoming a flow of output air after being cleaned within said chamber;

at least one nozzle through which a liquid is sprayed into said chamber, said liquid being electrically charged, said liquid becoming separated into a plurality of droplets upon exiting said at least one nozzle; and said chamber being configured to cause said flow of input air and said charged liquid droplets to intermix at an intermix space, wherein said plurality of particles are attracted to said charged liquid droplets, thereby removing a portion of said plurality of particles from said input air, which thus becomes said flow of output air;

wherein, when said flow of input air passes through said intermix space of said chamber at an air velocity of substantially 2.54 meters per second (500 fpm), said plurality of particles at substantially 0.3 microns in size is cleaned from said input air at a cleaning efficiency of greater than 70%, at a backpressure of less than 0.2 inches of water column, and without substantial change to a temperature and humidity of said input air.

2. The air cleaning apparatus as recited in claim 1, wherein, without cleaning or changing any component of said air cleaning apparatus, after 60 days of substantially continuous use the cleaning efficiency characteristic decreases less than 10% and the backpressure characteristic increases less than 10%, when said flow of input air exhibits a particle density greater than one million particles per cubic meter.

3. The air cleaning apparatus as recited in claim 1, wherein after they receive particles from said flow of input air, said liquid droplets are accumulated into a body of liquid, which is recirculated back to said at least one nozzle, and a surface of said liquid droplets is effectively renewed for each cycle of electrical charging, thereby allowing said liquid to be used over an extended time period of at least 4 months before becoming sufficiently dirty such that its surface will not take a sufficient electrical charge to attract said particles at a desired cleaning efficiency.

4. The air cleaning apparatus as recited in claim 1, wherein said liquid exhibits a conductivity of less than $10^{-4}$ $ohm^{-1}$ $m^{-1}$.

5. The air cleaning apparatus as recited in claim 1, wherein said liquid exhibits a relaxation time of greater than 0.1 seconds.

6. An air cleaning apparatus, comprising:

a chamber into which a flow of input air is directed, said input air containing a plurality of particles, said input air becoming a flow of output air after being cleaned within said chamber;

at least one nozzle through which a liquid is sprayed into said chamber, said liquid being electrically charged, said liquid becoming separated into a plurality of droplets upon exiting said at least one nozzle; and said chamber being configured to cause said flow of input air and said charged liquid droplets to intermix at an intermix space, wherein said plurality of particles are attracted to said charged liquid droplets, thereby removing a portion of said plurality of particles from said input air, which thus becomes said flow of output air;

wherein, when said flow of input air passes through said intermix space of said chamber at an air velocity of substantially 2.54 meters per second (500 fpm), said plurality of particles according to the ASHRAE dust spot test is cleaned from said input air at a cleaning efficiency of greater than 85%, at a backpressure of less than 0.1 inches of water column, and without substantial change to a temperature and humidity of said input air.

7. The air cleaning apparatus as recited in claim 6, wherein after they receive particles from said flow of input air, said liquid droplets are accumulated into a body of liquid, which is recirculated back to said at least one nozzle, and a surface of said liquid droplets is effectively renewed for each cycle of electrical charging, thereby allowing said liquid to be used over an extended time period of at least 4 months before becoming sufficiently dirty such that its surface will not take a sufficient electrical charge to attract said particles at a desired cleaning efficiency.

8. The air cleaning apparatus as recited in claim 6, wherein said liquid exhibits a conductivity of less than $10^{-4}$ $ohm^{-1}$ $m^{-1}$.

9. The air cleaning apparatus as recited in claim 6, wherein said liquid exhibits a relaxation time of greater than 0.1 seconds.

10. An air cleaning apparatus, comprising:

a chamber into which a flow of input air is directed, said input air containing a plurality of particles, said input air becoming a flow of output air after being cleaned within said chamber;

at least one nozzle through which a liquid is sprayed into said chamber, said liquid being electrically charged, said liquid becoming separated into a plurality of droplets upon exiting said at least one nozzle; and said chamber being configured to cause said flow of input air and said charged liquid droplets to intermix at an intermix space, wherein said plurality of particles are attracted to said charged liquid droplets, thereby removing a portion of said plurality of particles from said input air, which thus becomes said flow of output air;

wherein, when said flow of input air passes through said intermix space of said chamber at an air velocity of substantially 0.4572 meters per second (90 fpm), said plurality of particles at substantially 0.3 microns in size is cleaned from said input air at a cleaning efficiency of substantially 99.97%, at a backpressure of less than 0.8 inches of water column, and without substantial change to a temperature and humidity of said input air.

11. The air cleaning apparatus as recited in claim 10, wherein said backpressure is less than 0.2 inches of water column.

12. The air cleaning apparatus as recited in claim 10, wherein, without cleaning or changing any component of said air cleaning apparatus, after 60 days of substantially continuous use the cleaning efficiency characteristic decreases less than 10% and the backpressure characteristic increases less than 10%, when said flow of input air exhibits a particle density greater than one million particles per cubic meter.

13. The air cleaning apparatus as recited in claim 10, wherein after they receive particles from said flow of input air, said liquid droplets are accumulated into a body of liquid, which is recirculated back to said at least one nozzle, and a surface of said liquid droplets is effectively renewed for each cycle of electrical charging, thereby allowing said liquid to be used over an extended time period of at least 4 months before becoming sufficiently dirty such that its surface will not take a sufficient electrical charge to attract said particles at a desired cleaning efficiency.

14. The air cleaning apparatus as recited in claim 10, wherein said liquid exhibits a conductivity of less than $10^{-4}$ $ohm^{-1}$ $m^{-1}$.

15. The air cleaning apparatus as recited in claim 10, wherein said liquid exhibits a relaxation time of greater than 0.1 seconds.

16. An air cleaning apparatus, comprising:

a chamber into which a flow of input air is directed, said input air containing a plurality of particles, said input air becoming a flow of output air after being cleaned within said chamber;

at least one nozzle through which a liquid is sprayed into said chamber, said liquid being electrically charged, said liquid becoming separated into a plurality of droplets upon exiting said at least one nozzle; and said chamber being configured to cause said flow of input air and said charged liquid droplets to intermix at an intermix space, wherein said plurality of particles are attracted to said charged liquid droplets, thereby removing a portion of said plurality of particles from said input air, which thus becomes said flow of output air;

wherein, when said flow of input air passes through said intermix space of said chamber, said plurality of particles is cleaned from said input air at a pressure adjusted efficiency (PAE), which represents the cleaning efficiency in percent divided by the backpressure, that does not deviate by more than 25% after two months of continuous use of said air cleaning apparatus.

* * * * *